US010183850B2

(12) United States Patent
Hoffend, Jr. et al.

(10) Patent No.: US 10,183,850 B2
(45) Date of Patent: Jan. 22, 2019

(54) COMPACT HOIST SYSTEM

(71) Applicant: Electronic Theatre Controls, Inc., Middleton, WI (US)

(72) Inventors: Donald Aloysius Hoffend, Jr., Alexandria, VA (US); Donald Aloysius Hoffend, III, Annandale, VA (US)

(73) Assignee: Electronic Theatre Controls, Inc., Middleton, WI (US)

( * ) Notice: Subject to any disclaimer, the term of this patent is extended or adjusted under 35 U.S.C. 154(b) by 51 days.

(21) Appl. No.: 14/133,652

(22) Filed: Dec. 19, 2013

(65) Prior Publication Data

US 2014/0175353 A1 Jun. 26, 2014

Related U.S. Application Data

(63) Continuation-in-part of application No. 13/725,831, filed on Dec. 21, 2012, now Pat. No. 9,700,810.

(51) Int. Cl.

| | |
|---|---|
| ***B66D 1/02*** | (2006.01) |
| ***B66D 1/28*** | (2006.01) |
| ***B66D 1/38*** | (2006.01) |
| ***B66D 5/32*** | (2006.01) |
| ***B66D 5/16*** | (2006.01) |
| ***B66D 1/26*** | (2006.01) |

(Continued)

(52) U.S. Cl.

CPC ..... *B66D 5/16* (2013.01); *A63J 1/028* (2013.01); *B66D 1/26* (2013.01); *B66D 1/28* (2013.01); *B66D 1/39* (2013.01); *B66D 1/54* (2013.01); *B66D 1/56* (2013.01)

(58) Field of Classification Search

CPC ... B66D 1/36; B66D 1/38; B66D 1/39; B66D 1/26; B66D 1/28; B66D 1/54; B66D 1/56; B66D 5/16; A63J 1/028

USPC ..... 254/264, 266, 270, 389, 390, 334, 337, 254/385, 417; 212/330, 247, 312; 187/414; 248/49, 58

See application file for complete search history.

(56) References Cited

U.S. PATENT DOCUMENTS

| | | | |
|---|---|---|---|
| 3,428,298 | A | 2/1969 | Powell |
| 3,670,977 | A | 6/1972 | Boneck |

(Continued)

FOREIGN PATENT DOCUMENTS

| | | | |
|---|---|---|---|
| EP | 2455151 | A1 | 5/2012 |
| KR | 100888768 | | 3/2009 |
| KR | 101323793 | B1 * | 10/2013 |

OTHER PUBLICATIONS

EP13863800.2 Extended European Search Report dated Aug. 30, 2016 (7 pages).

*Primary Examiner* — Tan Le

(74) *Attorney, Agent, or Firm* — Michael Best & Friedrich LLP

(57) ABSTRACT

A hoist system having a drum primarily self-contained within a batten, for raising and lowering lighting, sound equipment, curtains and the like in a performance environment. The hoist system may be adapted with safety mechanisms including an overload sensor and/or a slack line detector. The system may be provided in the form of a point hoist. The compact system is highly scalable to a variety of spaces and applications, including school and public theaters and concert halls, as well as some homes, private business, etc. Additional features include various cable management systems and trim adjustment mechanisms for use with the hoist system.

16 Claims, 26 Drawing Sheets

(51) Int. Cl.

| | |
|---|---|
| ***B66D 1/39*** | (2006.01) |
| ***B66D 1/56*** | (2006.01) |
| ***A63J 1/02*** | (2006.01) |
| ***B66D 1/54*** | (2006.01) |

(56) References Cited

U.S. PATENT DOCUMENTS

| | | | | | |
|---|---|---|---|---|---|
| 3,776,367 | A | * | 12/1973 | Grove | B66F 11/046 182/2.11 |
| 4,118,907 | A | * | 10/1978 | Small | B66F 17/006 182/19 |
| 4,199,133 | A | | 4/1980 | Gagnon et al. | |
| 4,303,237 | A | | 12/1981 | Hoffend, Jr. et al. | |
| 4,497,470 | A | * | 2/1985 | Carter et al. | |
| 4,662,628 | A | | 5/1987 | Chatenay epouse Compagnon | |
| 4,892,203 | A | | 1/1990 | Arav | |
| 5,101,215 | A | * | 3/1992 | Creaser, Jr. | E04H 12/182 343/883 |
| 5,123,131 | A | | 6/1992 | Jandrakovic | |
| 5,314,047 | A | * | 5/1994 | Nielson | |
| 5,593,138 | A | | 1/1997 | Zaguroli, Jr. | |
| 5,607,142 | A | | 3/1997 | Nilsson | |
| 5,697,757 | A | * | 12/1997 | Lindsay | B66F 11/048 212/197 |
| 6,158,555 | A | * | 12/2000 | Brown, Jr. | H02G 11/003 187/414 |
| 6,253,502 | B1 | * | 7/2001 | Layton | H01Q 1/3216 212/180 |
| 6,634,622 | B1 | | 10/2003 | Hoffend, Jr. | |
| 6,691,986 | B2 | | 2/2004 | Hoffend, Jr. | |
| 6,889,958 | B2 | | 5/2005 | Hoffend, Jr. | |
| 6,988,716 | B2 | | 1/2006 | Hoffend, Jr. | |
| 6,997,442 | B2 | | 2/2006 | Hoffend, Jr. | |
| 7,104,492 | B1 | | 9/2006 | Massell et al. | |
| 7,258,325 | B2 | | 8/2007 | Hoffend, Jr. | |
| 7,293,762 | B2 | | 11/2007 | Hoffend, Jr. | |
| 7,484,715 | B2 | | 2/2009 | Hoffend, Jr. | |
| 7,607,644 | B1 | | 10/2009 | Gibb et al. | |
| 7,775,506 | B2 | | 8/2010 | Hoffend, III | |
| 7,810,792 | B2 | | 10/2010 | Hoffend, Jr. | |
| 7,854,423 | B2 | | 12/2010 | Hoffend, Jr. | |
| 8,033,528 | B2 | | 10/2011 | Hoffend, III | |
| 8,047,507 | B2 | | 11/2011 | Hoffend, Jr. | |
| 8,286,946 | B2 | | 10/2012 | Hoffend, Jr. | |
| 8,317,159 | B2 | | 11/2012 | Hoffend, III | |
| 8,613,428 | B2 | | 12/2013 | Hoffend, III | |
| 8,708,314 | B2 | | 4/2014 | Scott | |
| 8,789,814 | B2 | | 7/2014 | Hoffend, Jr. | |
| 8,905,702 | B1 | * | 12/2014 | Jedneak | B60P 1/00 212/328 |
| 2004/0098944 | A1 | | 5/2004 | Hoffend | |
| 2005/0104053 | A1 | | 5/2005 | Miller et al. | |
| 2006/0180564 | A1 | * | 8/2006 | Keppel | B66C 9/08 212/330 |
| 2007/0039783 | A1 | | 2/2007 | Doran | |
| 2008/0185564 | A1 | | 8/2008 | Lafreniere | |
| 2009/0127527 | A1 | | 5/2009 | Hoffend, III | |
| 2009/0140221 | A1 | | 5/2009 | Hoffend, III | |
| 2010/0301292 | A1 | | 12/2010 | Hoffend, III | |
| 2011/0193037 | A1 | | 8/2011 | Smith | |
| 2014/0175353 | A1 | * | 6/2014 | Hoffend, Jr. | B66D 1/26 254/376 |

* cited by examiner

COMPACT HOIST SYSTEM

CROSS-REFERENCE TO RELATED APPLICATIONS

This application is a continuation-in-part of U.S. application Ser. No. 13/725,831, filed Dec. 21, 2012, the entirety of which is hereby incorporated herein by reference.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable.

REFERENCE TO SEQUENCE LISTING, A TABLE, OR A COMPUTER PROGRAM LISTING COMPACT DISK APPENDIX

Not Applicable.

BACKGROUND OF THE INVENTION

Field of the Invention

The invention relates generally to an apparatus, system and method for moving a load. More specifically, the invention relates to a compact hoist system with potential applicability in a theater, concert hall or stage environment, for raising and lowering curtains, scenery, lights and the like, as well as in a variety of other home and business contexts.

Description of the Related Art

Conventional lift or hoist systems of a variety of types are known for use in theatrical or other performance environments. A typical system may include a large rectangular casing having therein a winch or other motor, a drive mechanism, a drum around which winds lifting or support cable, along with various controllers, sensors and safety mechanisms.

The mechanics of a conventional hoist system may be fixed to a framing beam or other secure, elevated structure of the performance location. Elongate cables or other members emerge from the mechanics, potentially re-routed by pulleys and other features prior to descending, and are typically connected to a batten or other structure to which are connected items to be raised or lowered, such as lights, speakers, curtains, etc.

An alternative implementation has the elongate members fixed to the overhead structure, with the other end of the elongate members descending downward toward and supporting the mechanics of the hoist, which move upward and downward along with the items to be raised and lowered, which commonly are connected to a batten attached to a body of the hoist.

Conventional hoist systems tend to be bulky, with asymmetrical enclosures and external battens, which may lead to a costly loss of space in cramped environments, complicated retrofit projects or, in cases of new construction, expensive custom designs.

SUMMARY OF THE INVENTION

The invention relates to a hoist system, method and apparatus. In one embodiment, the invention includes a hoist or lift contained within a compact structure. In a more specific embodiment, the invention seeks to offer a compact and highly adaptable self-climbing hoist system, at least some of the components of which are confined within an enclosure of the same. In a still more specific embodiment, the enclosure may be a tube or batten to which are attached items to be raised and/or lowered. The design of the invention is such that it may be scalable to a wide variety of sizes and applications.

In one aspect, a hoist in accordance with an embodiment of the invention includes a pipe batten or other object, for raising and lowering items under control of a motor-driven drum having wound around it an elongate member fixed to an elevated support, thereby raising and lowering the hoist upon rotation of the drum, wherein the drum is disposed within the pipe batten or other object. Depending upon a particular application, this arrangement may permit use of a hoist that is lighter, occupies less space and/or requires a motor having less torque, among other features, as compared to other hoist designs.

In another aspect, a batten in accordance with the invention may further act as a structure for supporting desired features, including light and sound fixtures, sources of electrical power, etc.

In another aspect, a point hoist is provided in accordance with an embodiment of the invention, moveable throughout a variety of locations such as for use for less permanent lifting needs.

In another aspect of the invention, a safety mechanism is provided by way of a slack-line detector, having a mechanism for detecting a reduced tension in a supportive elongate member, as may result from an object to be raised/lowered encountering an obstruction during lowering. In response to detecting slack on the line, the associated system may be partially or completely shut down, among other possibilities.

In another aspect of the invention, a safety mechanism is provided by way of an overload sensor, having a mechanism for detecting a load that exceeds a desired or recommended capacity of the associated hoist system. In response to a determination that an excessive load is present, the associated system may be partially or completely shut down, among other possibilities.

In another aspect of the invention, a cable management system is provided for accommodating lengths of cabling, such as power cable to a motor or lighting, a control cable, etc.

In another aspect of the invention, a variety of patterns are disclosed that define an exit position of an elongate member from an enclosure with respect to other elongate members and/or the enclosure itself, enabling adaptation of the respective hoist systems to a variety of environments.

In another aspect of the invention, mechanisms are provided for fine tuning an operative length of an elongate member, permitting adjustments for leveling or otherwise modifying a hoist system setup, at installation or at other appropriate times.

In another aspect of the invention, a system is provided for enabling removal and reattachment of a drive mechanism, such as a motor, from or to a hoist system.

Other inventive aspects will be apparent from an analysis of the disclosure herein.

DETAILED DESCRIPTION OF THE INVENTION

In the following detailed description of the invention, reference is made to the figures, which illustrate specific, exemplary embodiments of the invention. It should be understood that varied or additional embodiments having different structures or methods of operation might be used without departing from the scope and spirit of the disclosure.

In one implementation, the invention comprises a self-contained, self-climbing hoist system, having a motor, and a drum around which winds one or more lengths of cable, rope or other elongate member, for lifting and lowering at least a portion of the system, thereby also lifting attached objects, with respect to a fixed support. Depending upon an intended application, the motor and drum may be partially or fully contained within a batten or other enclosure. A batten often takes the form of a pipe or tube batten, though other forms are contemplated. For example, the use of a length of material having a square or other polygonal, elliptical, or any other cross-section might be beneficial, depending upon a particular application. Articles to be raised and lowered may be attached to the pipe directly, or indirectly, such as through a laddered arrangement of one or more additional pipes or other support mechanism, depending upon a particular application.

Figure 1:
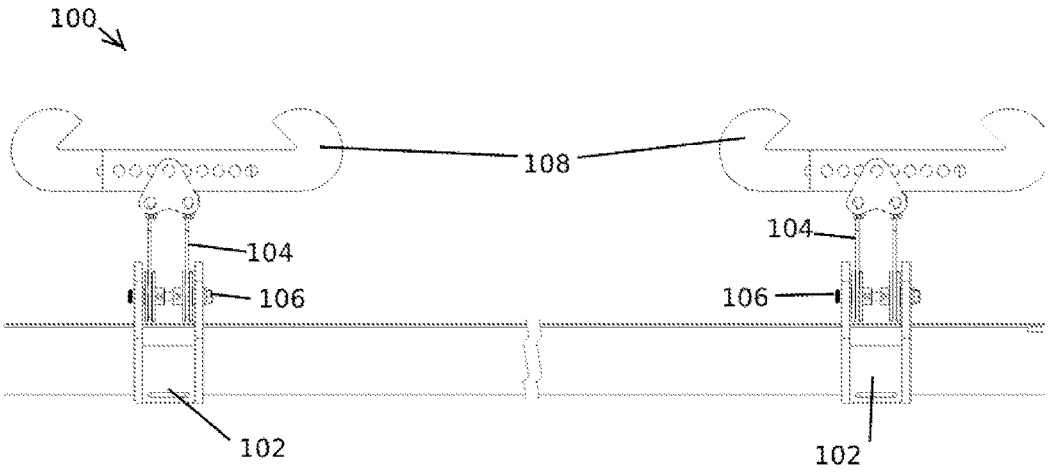
FIG. 1 is a partial perspective view of an embodiment of a hoist system in accordance with the invention, the view being truncated for illustration purposes.

An embodiment of the invention is illustrated by FIG. 1 as a hoist 100. In this embodiment, the hoist 100 is self-contained within a tube or pipe, here a batten 102. The size and/or shape of the batten 102, its method of manufacture, etc., may vary significantly depending upon a particular application. In one embodiment, the batten 102 is formed as an extrusion in a desired shape (i.e., cross section, generally, through the use of a die). The shape may be chosen for ease of attachment of a wide variety of attachments (temporary or permanent), including light fixtures, sound elements, power outlets, etc.

The batten 102 as illustrated houses a motor and drum. Powered by the motor, the drum rotates about an axis that may be substantially shared by the batten 102, spooling or winding an elongate member 104 around the drum. As explained in greater detail herein, the drum may, during rotation, further move in a direction parallel to its center axis and at a predetermined distance/rate with respect to the rotation, such that as the elongate member 104 encircles the drum, successive lengths thereof lay in direct contact with the drum, rather than the elongate member piling 104 atop itself.

The drum may further be adapted with grooves or ridges for receiving the successive lengths of the elongate member 104, such that an outer diameter of the combination of the drum and wound elongate member is 1) greater than an outer diameter of the drum itself by an amount less than a diameter of the elongate member, or 2) not increased at all by the elongate member 104, in a case that the elongate member 104 fits entirely within the grooves. In an application where elongate members 104 fit fully within grooves of the drum, a batten 102 may be chosen such that, as elongate members 104 encircle the drum, the batten 102 prevents the elongate members 104 from leaving the grooves, although tension on the elongate members 104 may not be fully maintained. In either case, this feature may enable a more compact design, e.g., the use of a tube of a relatively smaller diameter, depending upon a particular application.

An elongate member may be connected to a drum and adapted to wind thereabout in a variety of ways. In one embodiment, a drum is adapted to receive two elongate members 104 (or two lengths of a continuous elongate member 104 as further discussed herein) at an end. Thus, the grooves may be formed as a double-lead helical groove, i.e., double-start drums may be used. Three (triple)- or further multiple-lead arrangements are contemplated as well, depending upon a particular application. A multi-lead arrangement may increase strength and reliability over a single lead, provide redundancy as a safety measure, decrease noise and/or component wear, etc. For example, instead of an arrangement having two 3/32" leads, a single 1/8" lead, three 1/16" leads, etc., might be substituted, depending on needs. Although the wire ropes may be in close proximity, they do not cross over each other as they wind onto the drum. This may extend the life of a wire rope on average, avoiding the additional physical stresses that may occur through the piling of the rope, crossing over, etc.

As further described herein, a batten and drum may cooperate in a variety of ways. In one embodiment, a drum is entirely encompassed by a batten having the same shape as the drum, with the batten having an internal diameter (and circumference) only slightly larger that an external diameter (and circumference) of the drum. In certain applications, the difference may be on the order of a few thousandths of an inch, for example. The design parameters of the drum and batten may alternatively be such that the two surfaces are intended to remain in slight contact during operation, where the surface of the drum may be interrupted by grooves for receiving a wire rope. A depth of grooves in the drum may likewise be on the order of a few thousandths of an inch deeper than a diameter of the wire ropes.

In such an embodiment and others, materials for the batten and drum may be chosen accordingly. For example, a drum may be formed from a glass-filled nylon or other low-friction material with respect to a steel batten, among a number of other contemplated materials pairs.

Other factors contributing to a chosen tube diameter might include the nature of the cable or other elongate member. Winding a cable upon a small-diameter drum might degrade the cable over time, due to physical stresses within the strands or other material of which it is formed, imparted when the cable is over-flexed upon being wound. The use of a larger diameter drum might lessen these stresses, depending upon the relative diameters involved, the nature of the elongate member, etc.

In many applications, it is desirable to attach a hoist to a fixed, elevated structure. As shown in the exemplary embodiment of FIG. 1, the elongate member 104 emerges from the batten 102 through an opening, and may be used to couple the hoist assembly 100 directly or indirectly to an overhead structure or other support. Specifically, the elongate member 104 in FIG. 1 passes through a double sheave assembly 106, and is connected to a beam clamp 108 by any of a variety of means, as further described herein. The beam clamp 108 may be attached as desired to an elevated structure, such as an overhead beam in a concert hall or theater setting, among numerous other potential applications. Other means of installing a hoist assembly for use are contemplated, as would be understood by one skilled in the art.

The elongate member 104 may be fabric rope, wire rope or cable, among others. In one embodiment, four approximately 0.28 (3/32") inch wire ropes are used, though countless variations are contemplated, depending upon a variety of factors. In another embodiment, approximately 0.28 (3/32") inch wire ropes are attached at a separation of 1.125 (1 1/8) inch and wound at a 1/4 inch pitch (i.e., 4 grooves per rope per inch, i.e., 8 grooves per inch for a dual-rope, double-start drum). Single-rope hoists are contemplated as well, as for lighter-duty applications. Larger diameter or more numerous ropes, with the same or larger diameter drums, may be used for heavier duty applications.

As illustrated by FIG. 1, an elongate member 104 may be comprised of multiple (as shown, 2) strands of rope. In one embodiment, a single strand of elongate member 104 is connected at both ends to a beam clamp 108 or other means of attachment, while a body of the member 104 passes unbroken through the double sheave assembly 106 or other suitable means of attachment to the batten 102. This continuous U-shaped length of elongate member 104 may further be fitted with, for example, a compression sleeve (see FIG. 6), such that if one of the two (in this embodiment) substantially parallel lengths of member 104 breaks, the other does not pull through the assembly 106, and maintains its support of the hoist assembly 100. A compression sleeve may likewise be used to couple the ends of two separate elongate members 104 in an embodiment where two strands are used, or in a single-strand embodiment in which the continuous end is disposed within or near the beam clamp 108.

Figure 2:
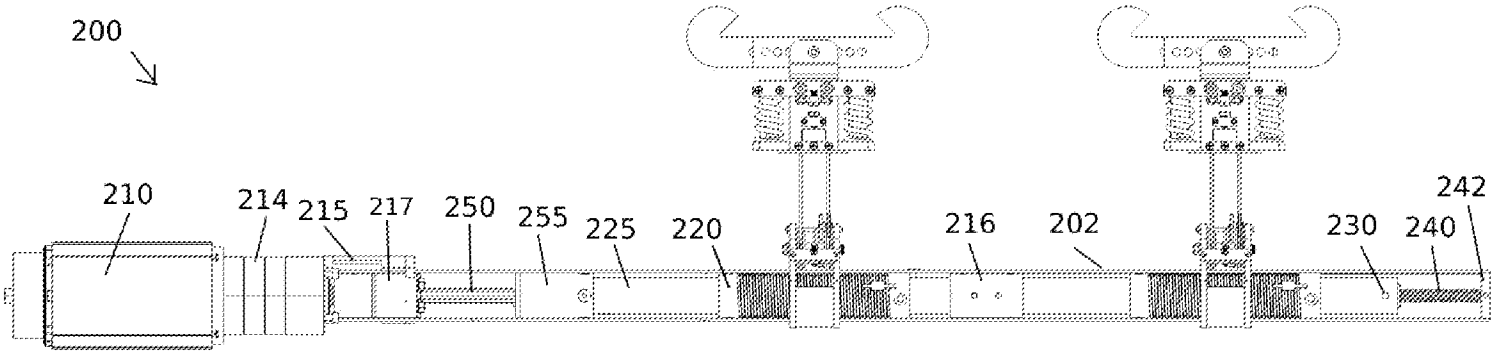
FIG. 2 is a perspective view of an embodiment of the internal mechanics of a hoist system in accordance with the invention.

FIG. 2 illustrates components of an embodiment of a hoist system 200 that may be internal to an enclosure or tube, for example a batten 102 as in FIG. 1 or a pipe batten 202 (illustrated transparently except for an outer periphery) as in FIG. 2, in accordance with the invention. Depending upon a particular application, an internal mechanism of the hoist system 200 might include a wide range of components, for example a motor 210, a gearbox 214, a gear mount to pipe batten coupling 215, a motor shaft to spline shaft coupling 217, a shaft coupling 216, a drum 220, a drum shaft or axle 225, a nut collar 230 fixed within the drum 220, an acme screw 240, a spline outer race housing 255, and a spline shaft 250 (see also FIG. 3 and description). In one embodiment, a motor 210 is coupled to and drives a drum 220 via a spline shaft 250, through which the motor 210 is able to impart a rotational force while allowing the drum 220 to slide, within a predetermined space, along the spline shaft 250. The spline shaft might further be connected to the acme screw 240 via the drum axle 225.

In operation, these components may share a center axis, or various components may be offset as desired, with certain components potentially disposed outside of the tube, depending upon constraints including space, lift capacity required, etc. For example, it might be desirable due to space constraints that the motor be disposed in an offset position, parallel to and coupled to the drum 220 using gears or other suitable means, such that a length of the tube and/or overall apparatus might be lessened.

Figure 3:
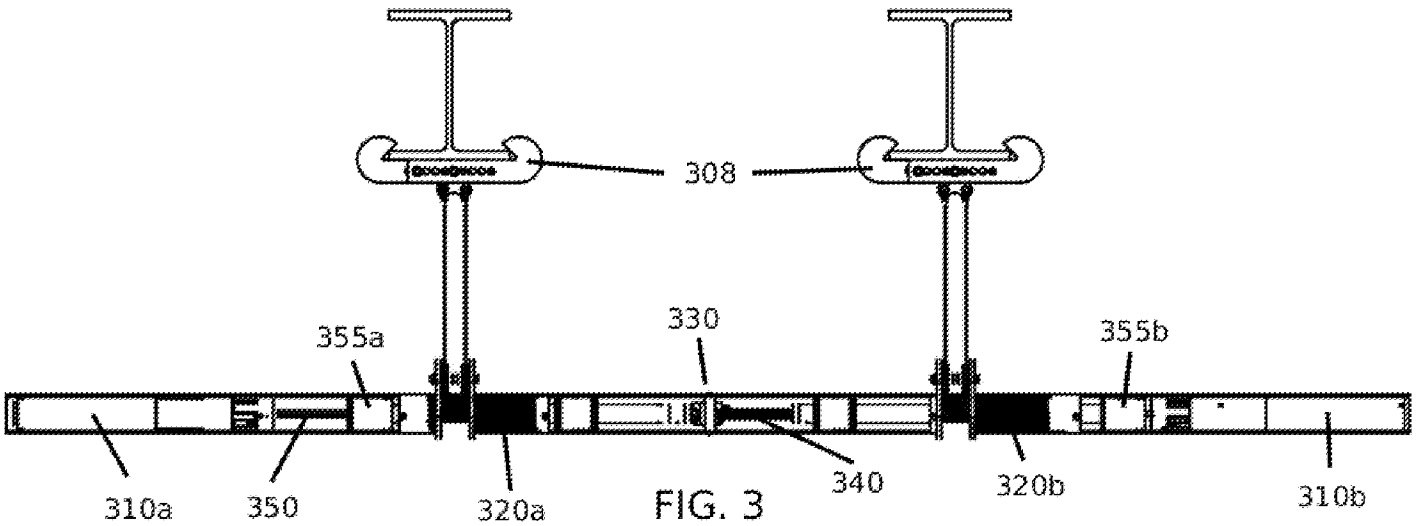
FIG. 3 is a perspective view of a dual-motor embodiment of a hoist system in accordance with the invention.

In one embodiment in accordance with the invention, as illustrated by FIG. 3, a hoist system 300 includes two motors 310*a* and 310*b* for driving two drums 320*a* and 320*b* disposed between the two motors 310*a* and 310*b*, one disposed at each approximate end of the associated enclosure, which may be a box, case, etc., here assumed for purposes of illustration to be a batten or other tube-like structure. Alternatively, the motors 310*a* and 310*b* or a single dual-drive motor might be disposed in an approximate center along a length of batten, or offset and having a nut collar or analogous feature at an approximate center, for driving the drums 320*a* and 320*b* positioned outwardly from the center, depending upon a particular application.

An operation of an implementation of a hoist system in accordance with the invention is described herein in the context of a dual-motor embodiment, with the associated concepts applicable as well to a single-motor embodiment, in accordance with the skill in the art. In another embodiment, a single motor, which might need to be of increased power in certain applications, is disposed at one end of a pipe or other enclosure, to drive one (1) or more drums about an acme screw fixed at the second end. For example, in a large venue application, e.g., an airplane hangar or terminal, a hoist of 300 or more feet might be needed, in which case it may be desirable to chain 15, 30 or more drums together. The invention is in that sense and others scalable and adaptable to a wide variety of potential implementations.

As described herein, the hoist system 300 might be designed such that, upon operation of the motors 310*a* and

310*b*, an approximately horizontal (assuming a normal operating position) translation of the drums 320*a* and 320*b* occurs.

In one embodiment, casings of the motors 310*a* and 310*b* and a nut collar 330 are fixed with respect to the tube, while rotors of the motors 310*a* and 310*b*, the drums 320*a* and 320*b*, an acme screw 340 and a spline shaft 350 are fixed with respect to each other, and turn within the tube. In addition to rotating within the tube, the drums 320*a* and 320*b* might be adapted for lateral (generally horizontal, assuming a normal operating position) movement along the spline shaft 350 by virtue of a pair (in a dual motor environment) of sliding couplers, herein spline couplers 355*a* and 355*b*, rotationally coupling each of the drums 320*a* and 320*b* to the spline shaft 350, i.e. transferring the driving force thereto, while allowing the drums 320*a* and 320*b* to respectively slide along the spline shaft 350 upon rotation, as described herein.

For example, an assembly of the two drums 320*a* and 320*b* and an acme screw 340 connecting them might be disposed in relation to the nut collar 330 such that upon rotation the two drums 320*a* and 320*b* move in unison along spline shaft 350, either toward one motor 310*a* or the other motor 310*b*, depending upon a direction of rotation. For example, the fixed-position nut collar 330 might be threaded to mate with threads of the acme screw 340, thereby imparting a generally horizontal force upon rotation of the acme screw 340 with respect to the respectively fixed nut collar 330. The resulting horizontal translation allows elongate members entering a fixed cutout in the tube to wrap around the drums 320*a* and 320*b* as the drums 320*a* and 320*b* rotate. Alternative arrangements leading to a similar result are possible as well.

In an alternative embodiment, the drums 320*a* and 320*b* move inward toward each other or outward away from each other, depending upon a direction of rotation of the motors 310*a* and 310*b*. Multiple nut collars 330 might be used or, as another example, one shaft might be threaded internally within another, etc., thus pulling the shafts inward. A relative direction of rotation of drums 320*a* and 320*b* is variable as well. For example, whether under control of a single or multiple motors 310*a* and 310*b*, the drums 320*a* and 320*b* might rotate in the same or opposite directions, either consistent with the directions of rotation of the motors 310*a* and 310*b* or, as in a single-motor embodiment, through the use of differentials to switch a direction of rotation inline. In one embodiment, depending upon an angle of exit of an elongate member from a batten, multiple such exits at the same angle along an outer periphery (e.g., circumference) of a batten (as might be the case when using drums that rotate in unison) might naturally lead to a torque being imparted on the batten. Utilizing drums rotating in opposite directions, with corresponding rope exits being on opposite sides (for example, at 10 o'clock and 2 o'clock, or 9 o'clock and 3 o'clock positions, about a cross-sectional periphery of a batten) of the batten, might beneficially lessen or eliminate (by counteraction) a collective torque on the batten.

Figure 4:
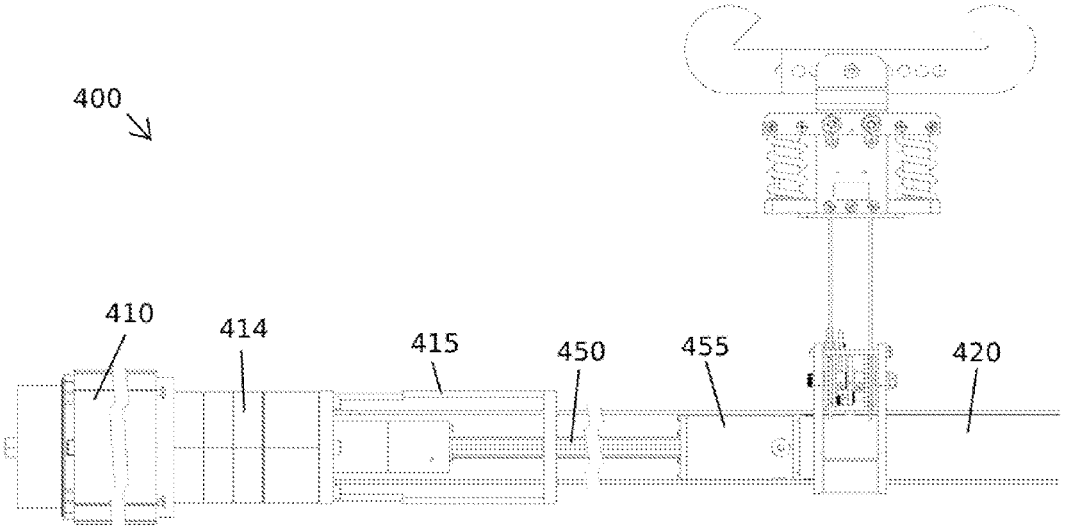
FIG. 4 is a perspective view of an embodiment of the internal mechanics of a hoist system in accordance with the invention.

As noted herein, an embodiment of a hoist 400 is contemplated in which a driving source, such as a motor 410, is disposed outside of a pipe 402, as illustrated by FIG. 4. The motor 410 in this embodiment is coupled to a threaded drive shaft such as a spline shaft 450 through an optional gear box 414 and pipe batten-to-gearbox coupling 415. A gear box 414 might allow use of a motor 410 having less horsepower or lower torque, which may be a tradeoff for higher revolutions-per-minute (RPM) to achieve a comparable lifting action (speed, maximum load, etc.). Pipe batten-to-gearbox coupling 415 connects and prevents respective motion between the pipe 402 and the gearbox 414.

Figure 5:
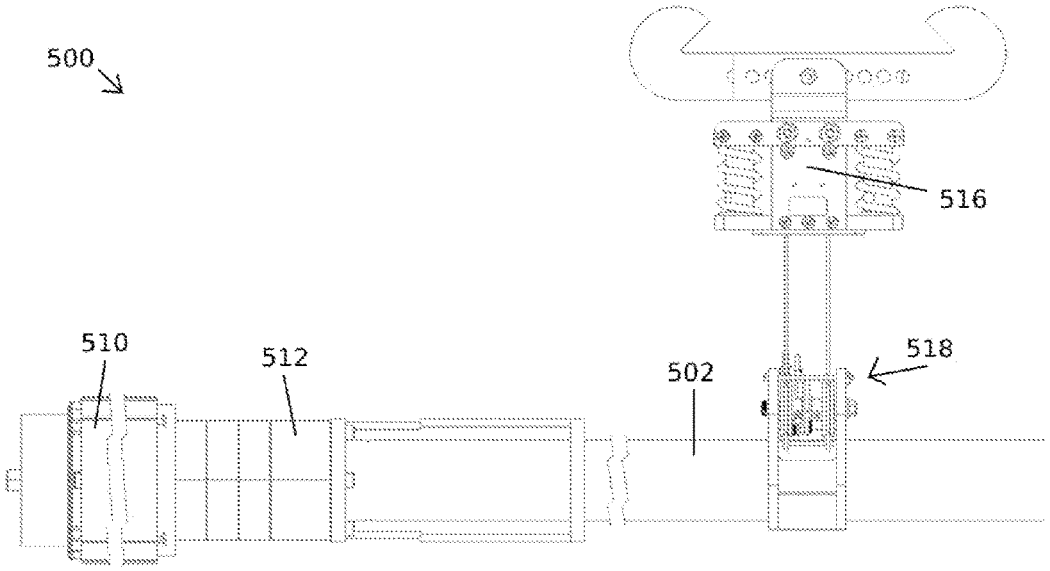
FIG. 5 is a detailed perspective view of an embodiment of a mechanism for connecting a batten to an overhead support in accordance with the invention.

A pipe batten 502, the position of which may be seen in FIG. 5, has been rendered transparent in FIG. 4 to better illustrate internal features such as a drum 420, a spline shaft 450 and a spline outer race to drum shaft coupling 455. In this embodiment, the spline outer race to drum shaft coupling 455 couple the spline shaft 450 to the drum 420, such that as the spline shaft 450 rotates under the power of the motor 410, the drum 420 translates parallel to a center axis (e.g., of rotation) of the spline shaft 450 (and in this embodiment, an axis of the motor 410). It is also contemplated that an axis of the motor 410 be offset from an axis of the spline shaft 450 if desired, such as to accommodate for space limitations.

It may further be seen in connection with FIGS. 4 and 5, as further described herein, that a batten 502 may be chosen to be only slightly larger than an outer surface (i.e., the lands of any grooves) of the drum 420. This may have the effect of, as wire ropes enter the batten 502 to be wound upon the drum 420, physically maintaining the wire ropes within the grooves around nearly an entire circumference of the drum 420 (in one embodiment, on the order of 340 degrees of the circumference).

FIG. 5 generally represents the view of FIG. 4 as a hoist system 500 having a motor 510 and a gearbox 512, without the transparency of the batten 502. In addition to the features described in the context of particular embodiments of the invention, it is contemplated that the features be variously used in other applications, and additional features are contemplated as well, including an overload sensor 518 and slack line detector 558, described in greater detail with respect to FIGS. 8 and 9, respectively.

Figure 6A:
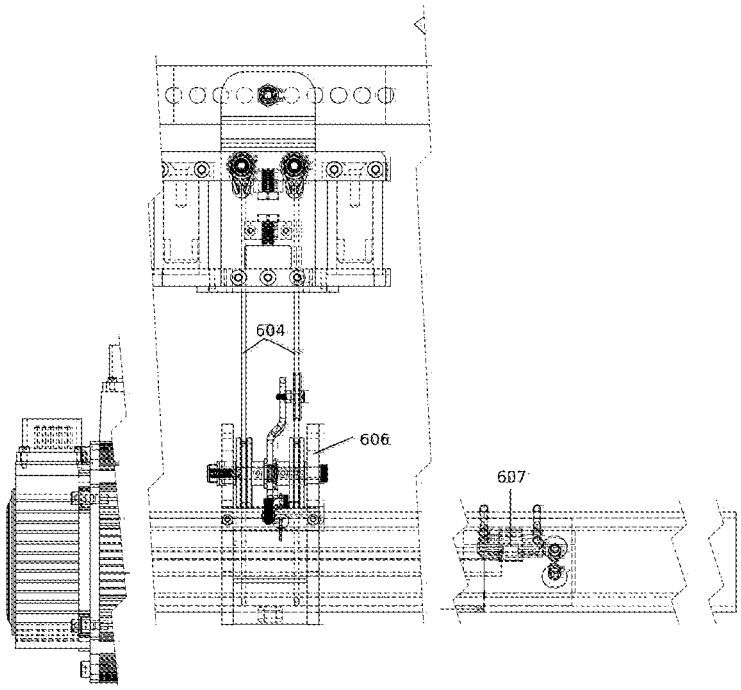
FIGS. 6A and 6B are detailed perspective views of an embodiment of a mechanism for connecting a wire rope to a double sheave assembly in accordance with the invention.
Figure 6B:
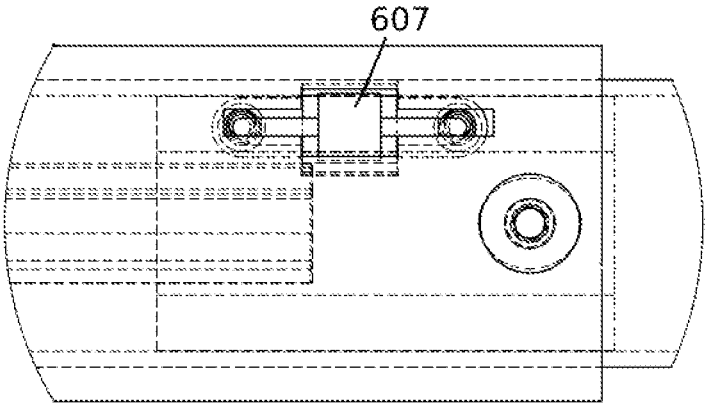

FIGS. 6A and 6B illustrate an embodiment of a mechanism for connecting a wire rope 604 and a sheave assembly 606. As discussed herein, a single length of wire rope 604 may be looped through the sheave assembly 606. In such an embodiment, it may be desirable to include an inline compression fitting 607, such that if the wire rope 604 fails in one of the two parallel portions, the hoist 600 will remain supported by the remaining length of wire rope 604, by virtue of the compression fitting preventing the wire rope 604 from freely pulling out of the assembly 606.

Figure 7:
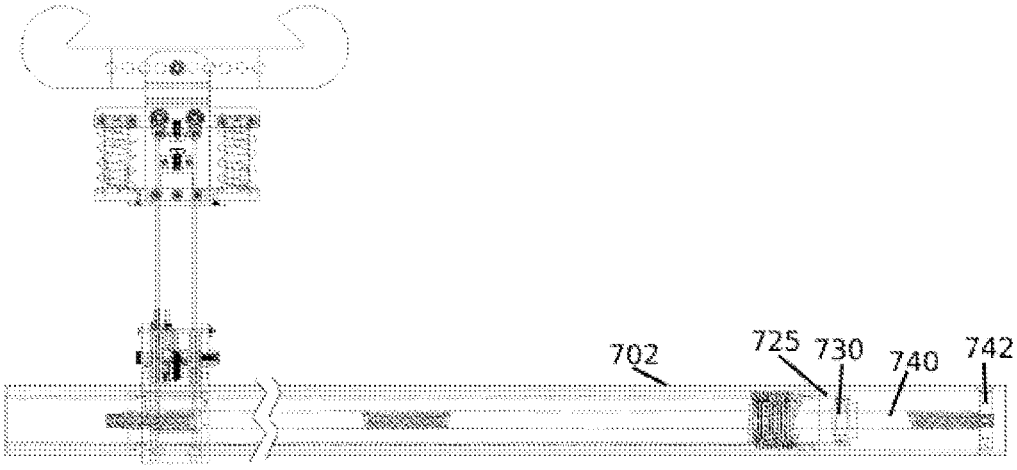
FIG. 7 is a detailed perspective view of the internal components of an embodiment of a hoist system in accordance with the invention.

An enlarged view of the cooperation between a drum shaft 725, an acme nut 730 and an acme screw 740 in accordance with an embodiment of the invention is provided by FIG. 7. The acme screw 740 in this embodiment is coupled to an interior wall of the pipe batten 702 by an acme screw anchor 742. As disclosed herein, as the acme screw 740 turns with respect to the screw anchor 742 (and pipe batten 702), the acme screw 740 and the drum (not shown) is drawn or pushed in a direction substantially parallel to the length of the pipe batten 702, depending upon a direction of rotation of the acme screw 740. Alternatively, the acme rod 740 may be held fixed, while an acme nut, e.g., screw anchor 740 is attached to the drum. As the acme nut 740 turns, it travels along the acme rod 740, moving the drum laterally.

Figure 8A:
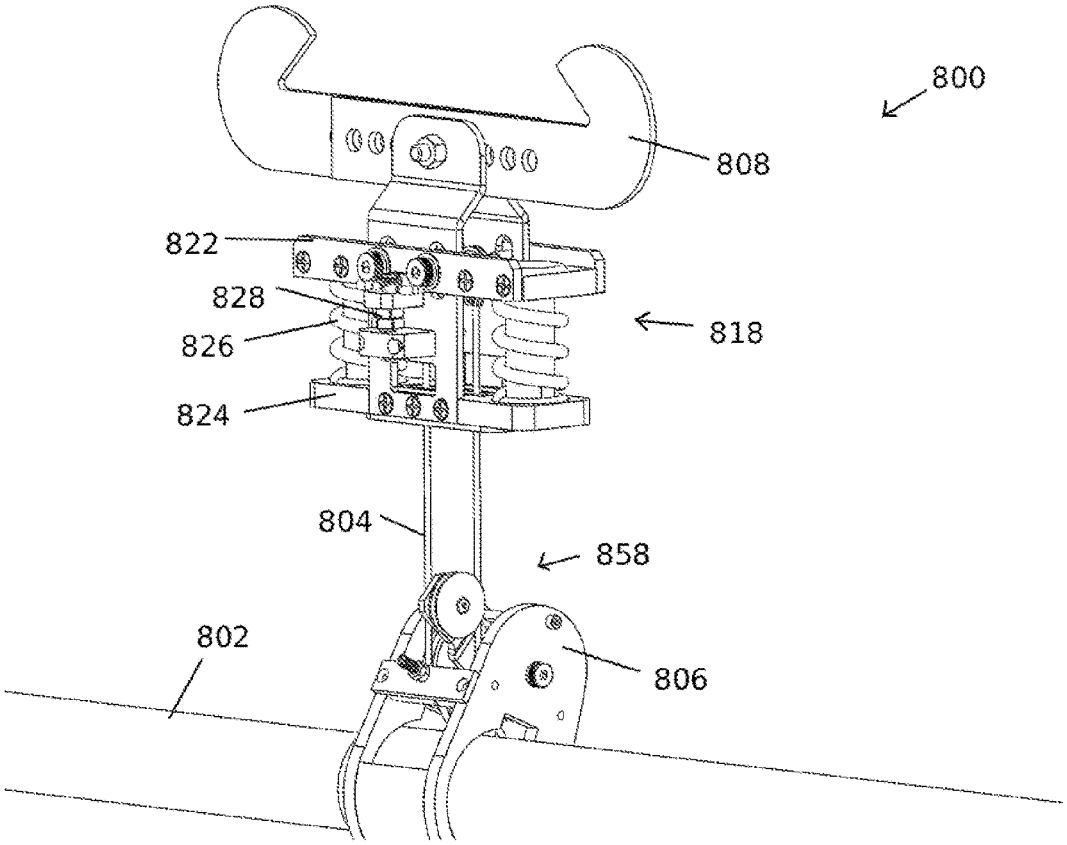
FIGS. 8A and 8B are a perspective view and sectional view respectively of an overload sensor in accordance with an embodiment of the invention.
Figure 8B:
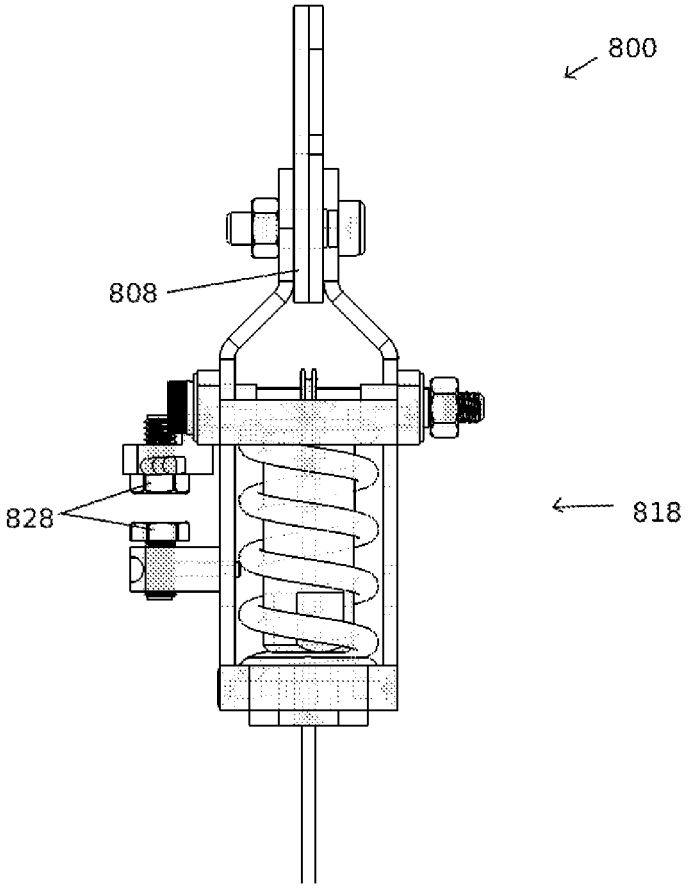

FIGS. 8A and 8B illustrate an embodiment of an overload sensor 818*a* and 818*b* that might be provided for use with a hoist 800 in accordance with the invention, such that if too great a load is placed upon the hoist 800, a portion or all of the overall system is disabled. In one embodiment, between a beam clamp 808 (or other suitable support mechanism) and a sheave assembly 806 (or other suitable attachment mechanism) are disposed a fixed bracket 824 coupled to the beam clamp 808 and moveably coupled to a sliding bracket 822. Between the fixed bracket 824 and the sliding bracket 822 may be disposed one or more compression springs 826 or other resistive means to assert a certain amount of resistive force against the movement of the sliding bracket 822 in the direction of the fixed bracket 824, each bracket having one or more ground-out contacts 828 that come into contact with each other upon a sufficient displacement of the sliding bracket 822 toward the fixed bracket 824. A strength of the springs 826 or other resistive means may be chosen such that contact between the contacts 828 only occurs under a pre-determined sufficiently great load has been placed on the elongate members 804. Contact between the contacts 828 may be designed to create a condition, such as an electrical ground-out, switch actuation, etc., sufficient to disable at least a portion of the system 800*a* to avoid operation during an overload situation.

In one embodiment, an internal shaft (e.g., drum shaft 725 in FIG. 7) is energized, for example with 24 volts or other appropriate potential, which will be electrically isolated, and which will energize at least one of the wire ropes (also electrically isolated, as by the drum), while the pipe 802 is connected to electrical ground through the motor. When the springs 826 of the overload sensor 818 are compressed (due to too much weight on the batten), the contacts 828, illustrated in the form of bolt heads, will contact each other, creating a ground-out situation through connection to the building steel or other support structure for example, stopping the pipe 802. Limiting the electrical current (in one embodiment, only 200 milliamps) running through the wire rope 804 can eliminate or reduce the risk of a harmful electrical shock if a person were to come into contact with the wire rope 804.

Another feature that might be offered in conjunction with the hoist electrical arrangement disclosed herein is a limit selector for controlling an operating range of motion (e.g. lifting range) of a hoist. In one embodiment, in which a drum translates as it rotates, a controller may be provided in connection with a moveable switch (not shown) placed in a path of the drum. The switch may be positioned such that when the drum translates to a certain location (corresponding to a certain lift position), the drum actuates the switch, in connection with the ground-out system, for example, to prevent further translation (and thus rotation) of the drum in the same direction (though it may still be reversed to lower a load to the extent of a second limit position). Through selection of positions of limit switches, the operable range of a hoist system might be variably chosen. FIG. 8 further illustrates a slack line detector 858, as described in greater detail herein with respect to FIGS. 9A and 9B.

Figure 9A:
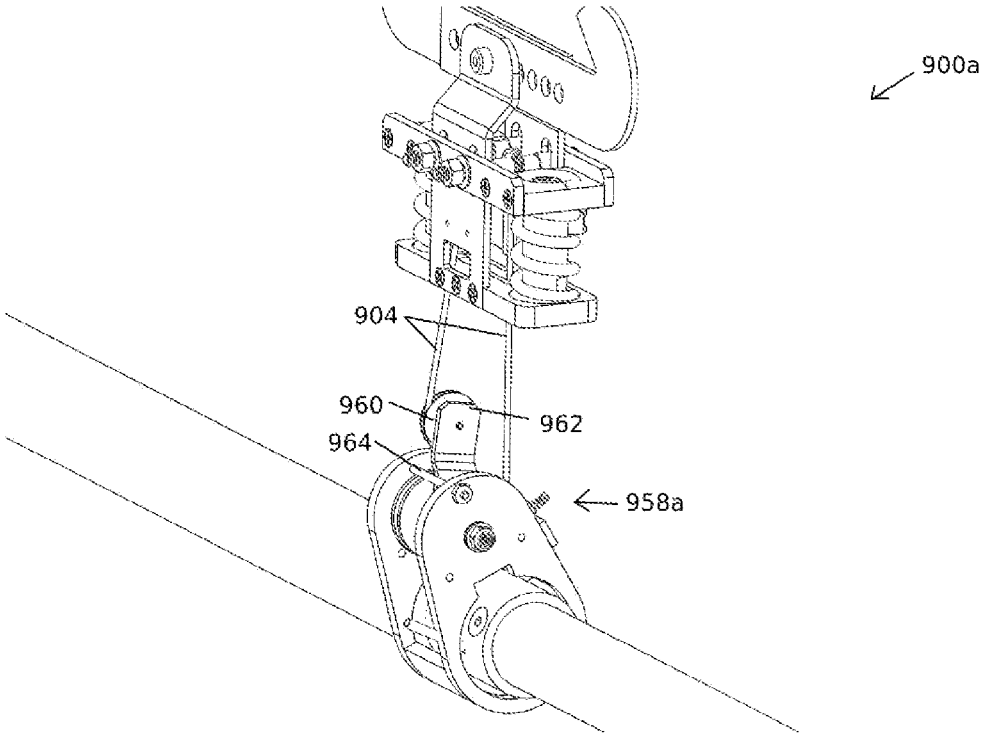
FIGS. 9A and 9B are perspective views of alternative embodiments of a slack line detector in accordance with the invention.
Figure 9B:
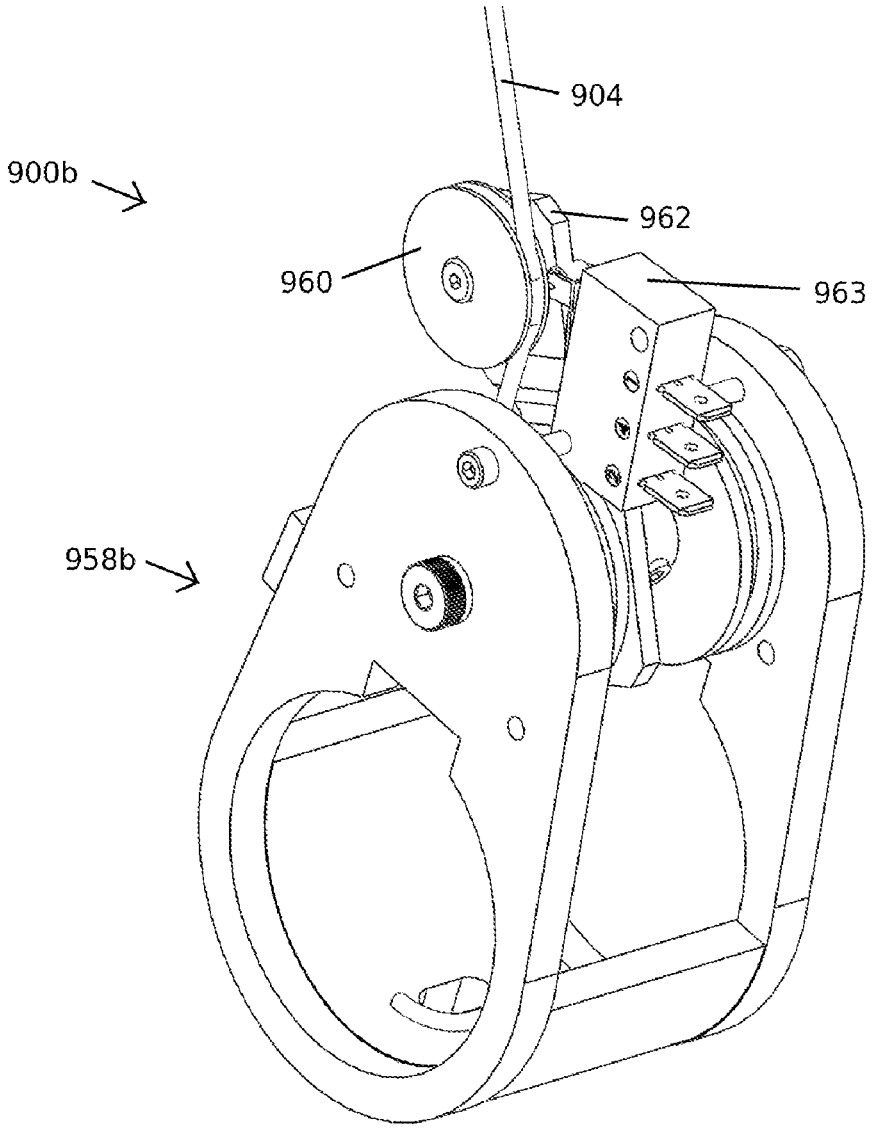

FIGS. 9A and 9B illustrate embodiments of a hoist 900 adapted with slack line detectors 958*a* and 958*b* for detecting a condition in which an expected tension on an elongate member 904 releases, as may occur when a load to be hoisted encounters an obstacle while being lowered. A slack line detector 958*a* may serve as an alternative to a ground out bar, which may run the length of, and parallel to, a drum, such that when a wire rope goes slack, it pulls or falls away from the grooves of the drum, contacting the ground out bar and stopping the system. The slack line detector 958*a* may be adapted to work in a variety of ways. In one embodiment, a tensioned (e.g., spring loaded) rocker arm 962 having a pulley 960 is positioned such that upon action of the spring or tensioning device (not shown) the arm 962 is contact with a bar 964 (see FIG. 9A). When the pulley 960 is disposed against a taut wire rope 904, the rocker arm 962 is pulled away from the bar 964 (see FIG. 8A). When the wire rope goes slack, the spring loaded arm 962 moves to contact the bar 964, creating a ground-out condition through connection to the detector 958*a*, which is connected to the grounded pipe, for example.

As described with respect to an overload sensor, one of the wire ropes 904 may be electrically charged while another wire rope 904 is electrically isolated, in which case contact between the wire ropes 904 will cause a ground out situation, stopping the system. The small pulley 960 may be formed from a metal or other conductive material, with the arm 962 being electrically isolated, such that it will ground upon contact with the small bar 964 to stop the system. In another embodiment, the arm 962 of a slack line detector 958*b* instead contacts and activates a micro-switch 963, electrically sending a signal to the motor to stop, as illustrated by FIG. 9B.

Figure 10:
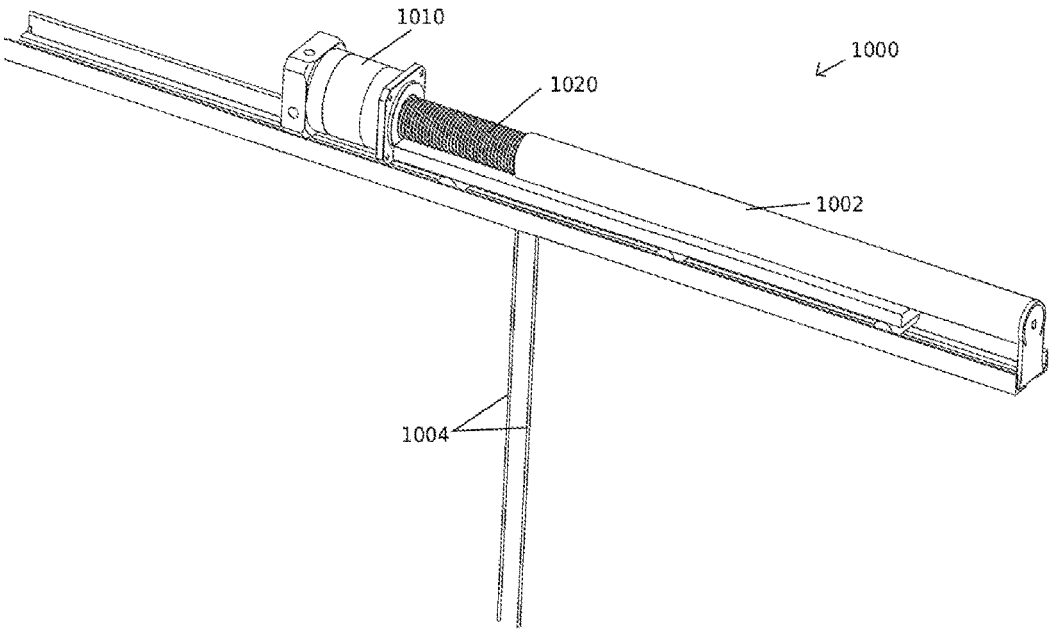
FIG. 10 illustrates a perspective view of a point hoist in accordance with an embodiment of the invention.

In another embodiment, a hoist is provided in the form of a type of movable point hoist, an embodiment of which is illustrated by FIG. 10. In a point hoist 1000, a motor 1010 may be attached to a drum 1020, which is drawn inward into a pipe or cover 1002 as the drum 1020 rotates, drawing up wire ropes 1004 and lifting or lowering an object or structure as desired, as described herein. In this embodiment, an acme rod 1040 would be held stationary (with respect to any translation along its length), while the drum 1020 would translate as it turns, drawing the assembly into the pipe or cover 1002. A point hoist may be mounted to a simple aluminum channel, for example, as opposed to being inside a pipe. This channel could be mounted to a grid or other means above the stage, etc. and could be moved to different positions. The motor 1010 and drum 1020 may be mounted on bearings or other low friction or otherwise slide-friendly surface within the channel. In one embodiment, a point hoist will weigh approximately 50 pounds for ease of movement. As noted, in certain applications a point hoist 1000 has a drum 1020 that is not necessarily confined within a pipe 1002, which may permit use of a larger diameter wire rope (⅛ inch, 3/16 inch, etc.), which may enable lifting a heavier load.

Figure 11A:
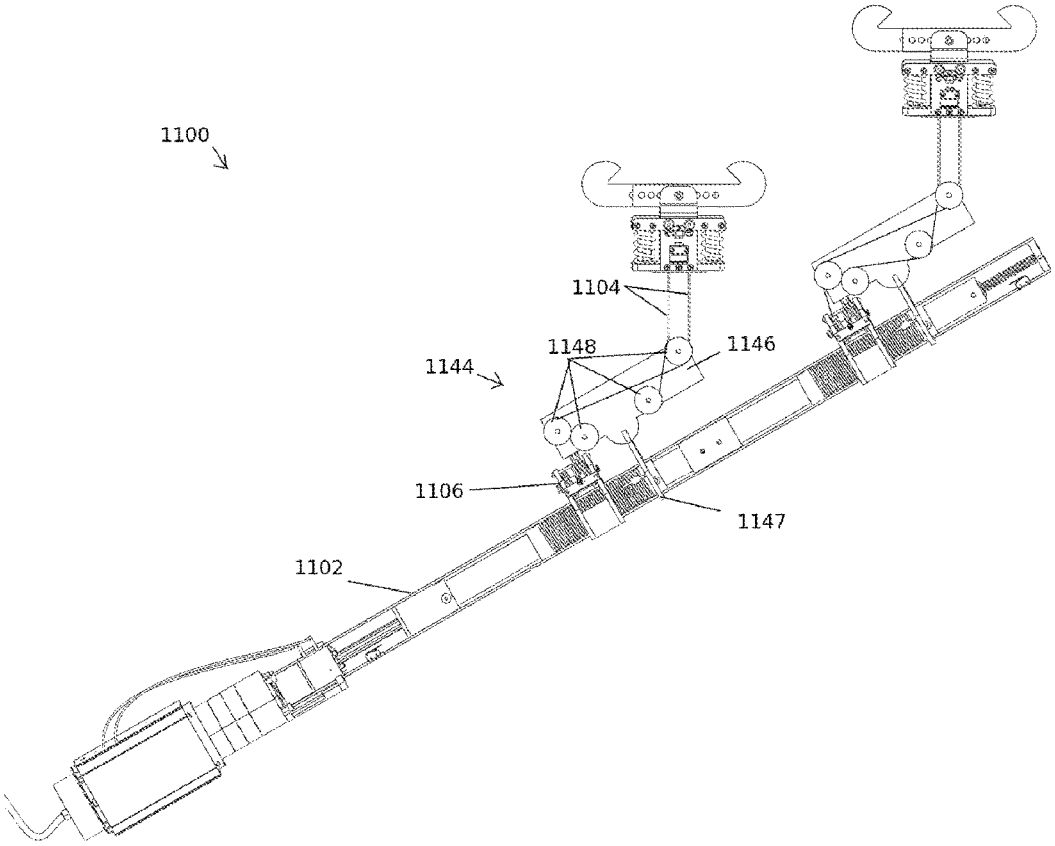
FIGS. 11A and 11B illustrate perspective views of alternative embodiments of a diverter pulley system in accordance with the invention.

Herein, various hoist systems have been illustrated by way of example as primarily having elongate members exiting a batten or related structure and extending substantially vertically, such as to fixed overhead locations. It should be noted, however, that a hoist system in accordance with the invention is further versatile in this aspect. FIG. 11A illustrates a hoist system 1100 with a batten 1102 having connected thereto a double sheave assembly 1106 that has been adapted for use with a diverter pulley system 1144, which may be termed a muled diverter. The pulley system 1144 is formed from a bracket 1146 coupled to the batten 1102 along its length by a mount 1147. The pulley system 1144 is mounted a distance from a sheave assembly 1106 to divert elongate members 1104 approximately laterally along the batten 1102 through the use of pulleys 1148, in order adapt to varying overhead attachment locations and scenarios.

In the exemplary embodiment illustrated, the bracket 1146 is formed from a unitary piece of material, adapted for a predetermined overhead location, however it may alternatively be formed from multiple individual pieces, in one embodiment having a set of pulleys 1148 positioned near the sheave assembly 1106, and another set of pulleys 1148 attached to a second bracket, moveable along a length of the batten 1102. Alternatively, such a bracket 1146 assembly may slide to lengthen, to adapt for varying points of overhead attachment. As further illustrated by FIG. 11, a hoist system 1100 of the type shown may also accommodate scenarios in which overhead support structures are at an angle (i.e., not level) and/or in which the batten 1102 itself is desired to be used at an angle, independent of an orientation of overhead support structures.

Figure 11B:
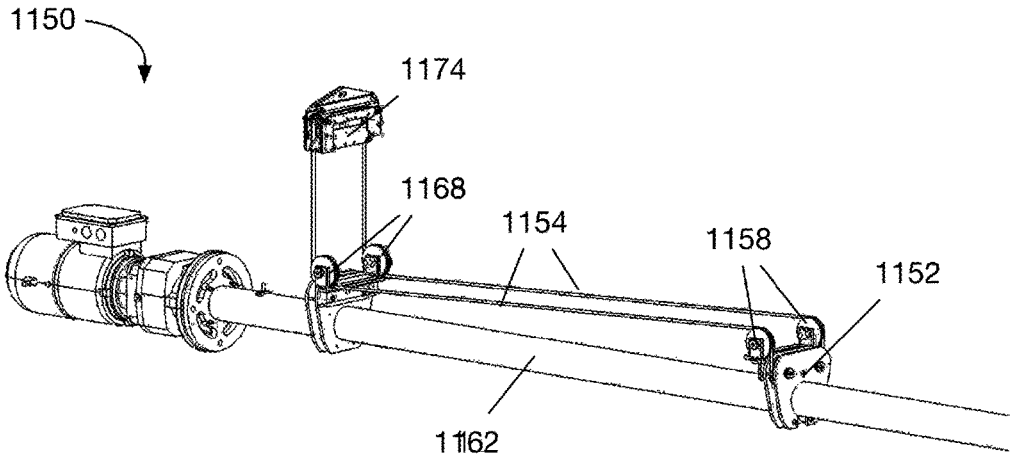

FIG. 11B illustrates an alternative embodiment as a muled diverter system 1150. An elongate member exit mechanism 1152 (see FIG. 12C, mechanism 1250, and associated disclosure for exemplary greater detail), including supplemental pulleys 1158, may be utilized to divert exiting elongate members 1154 along a length of an enclosure 1162, through a second set of pulleys 1168 supported by a support mechanism 1172. This allows the elongate members 1154 to then extend substantially vertically at a different location to an overhead support 1174, which may additionally provide for trim adjustment (see, e.g., FIG. 12D, trim adjustment mechanisms 1270), among a variety of other options.

Figure 12A:
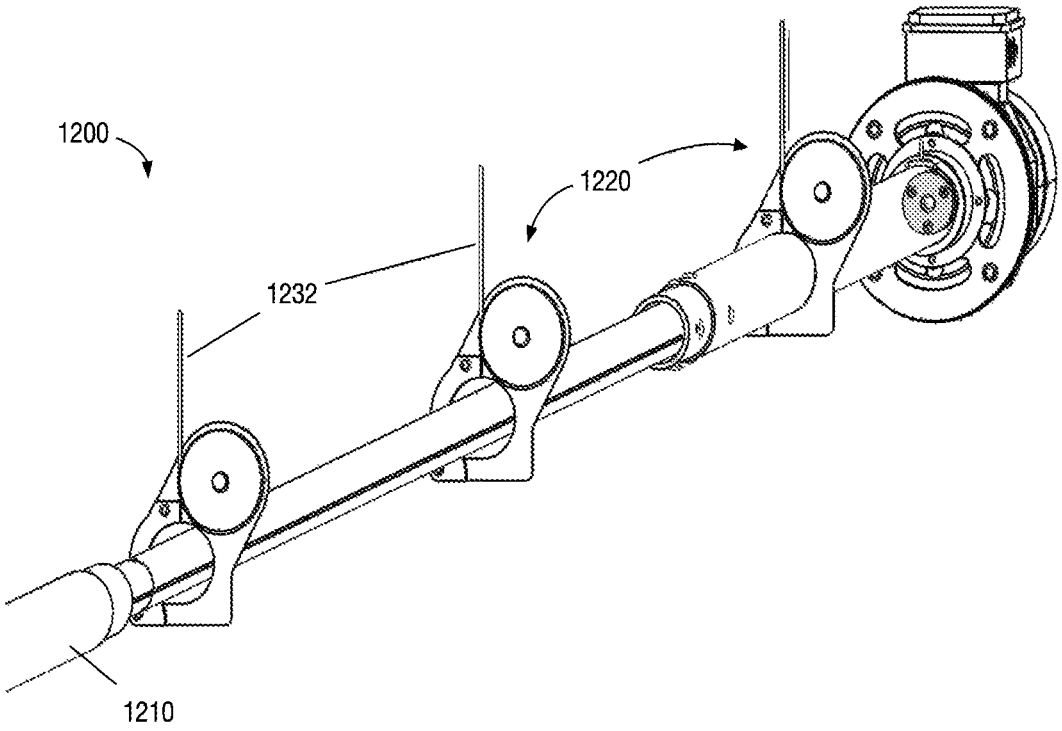
FIGS. 12A-D illustrate perspective views of alternative embodiments of elongate member exit arrangements in accordance with an embodiment of the invention.
Figure 12B:
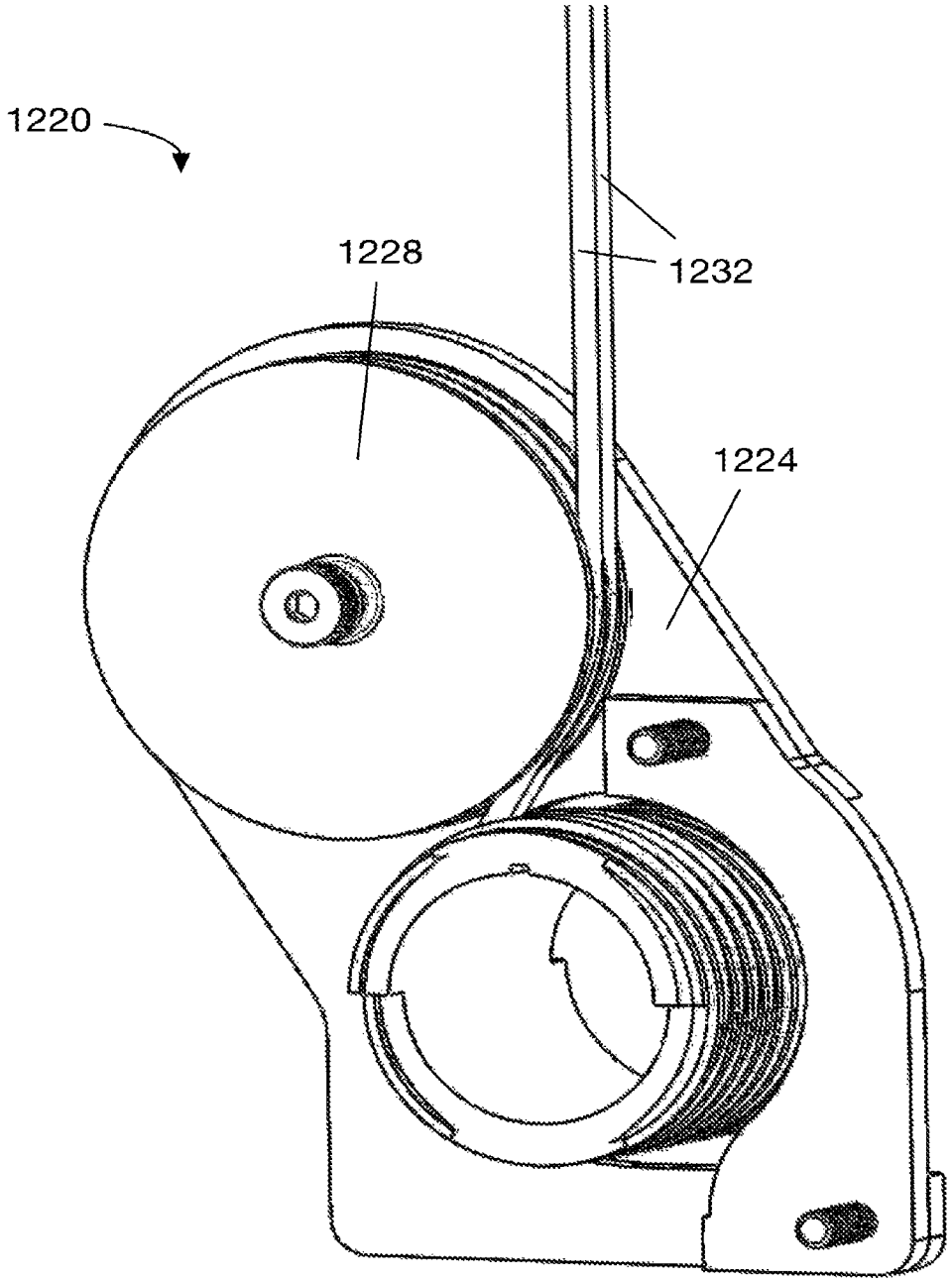

As noted herein, alternative configurations are contemplated with respect to exit points of one or more elongate members from an enclosure of a hoist. For context, FIG. 12A illustrates a perspective view of a modification of the embodiment of FIG. 9A, i.e., an embodiment of a hoist system 1200 that may be configured such that an elongate member 1232 exits the enclosure 1210 substantially at the operative top (in the direction of an overhead support) of the enclosure 1210. In FIG. 12A, for purposes of illustration, a portion of the enclosure 1210 is shown as being cut away to reveal a drum 1214 upon which an elongate member 1232 winds in operation. A series of exit assemblies 1220 are provided along a length of an enclosure 1210. FIG. 12B illustrates a more detailed perspective of one of the exit assemblies 1220, which includes a multi-part plate apparatus 1224 supporting, in this embodiment, a double pulley arrangement 1228, for guiding a set of elongate members 1232 upon exit from the enclosure 1210 (not shown in FIG. 12B). As illustrated, in an operative position, the elongate members 1232 may exit substantially vertically upward to an overhead support structure.

Figure 12C:
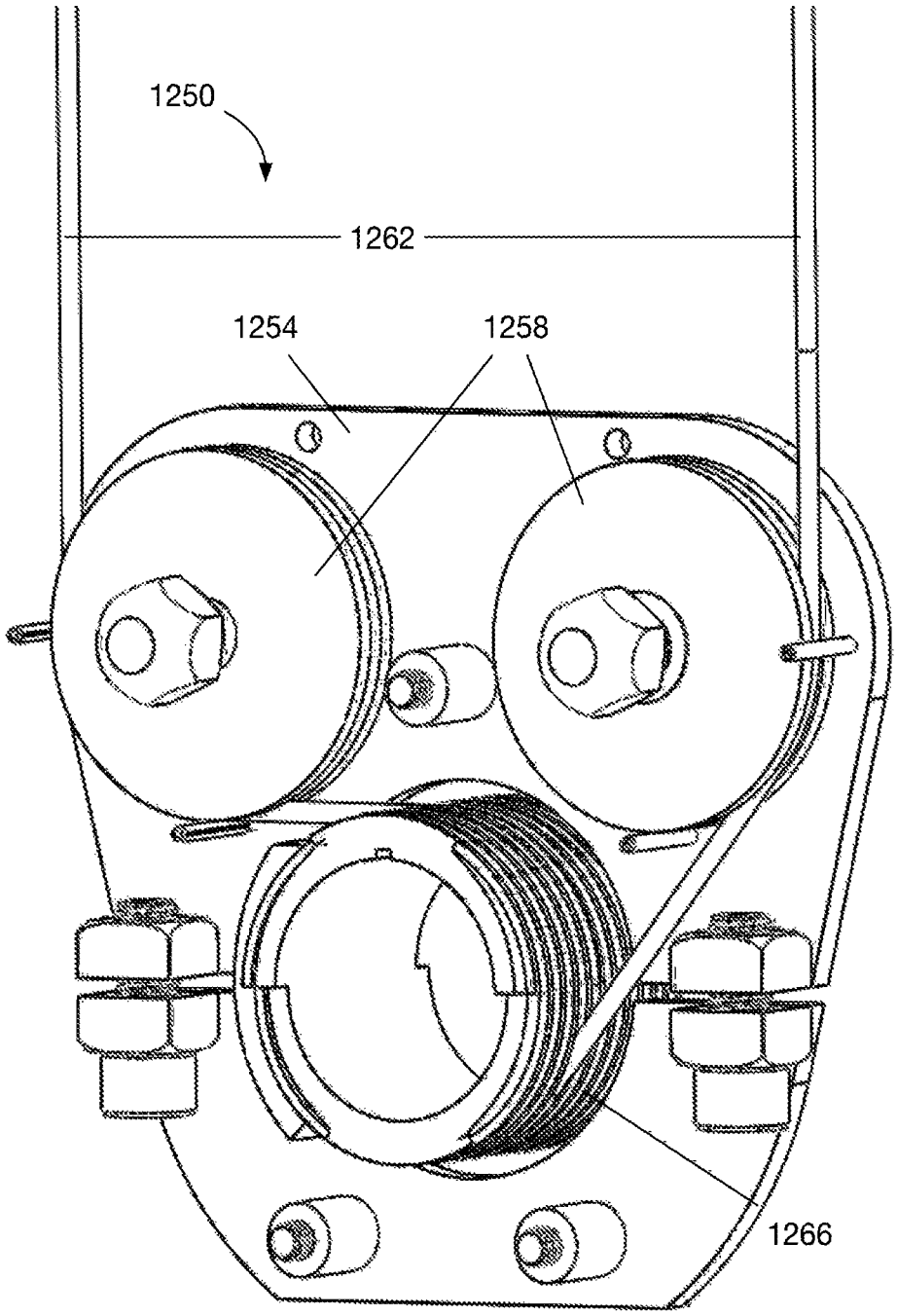

In an alternative embodiment, illustrated by FIG. 12C, elongate members exit the enclosure instead at, for example, approximately 3:00 and 11:00 (where, as will be readily appreciated by one skilled in the art, 12:00 represents a direction/angle vertically upward toward an overhead support, when viewing a cross section of the enclosure, e.g., a batten). A functionally similar exit mechanism 1250 includes a multi-part plate apparatus 1254 supporting a double-pulley arrangement 1258, wherein the individual pulleys are separated by a distance, and in operation may rotate in opposite directions while guiding a direction of the elongate members 1262 as they exit from a drum 1266 through the enclosure (not shown; see FIG. 12D).

Figure 12D:
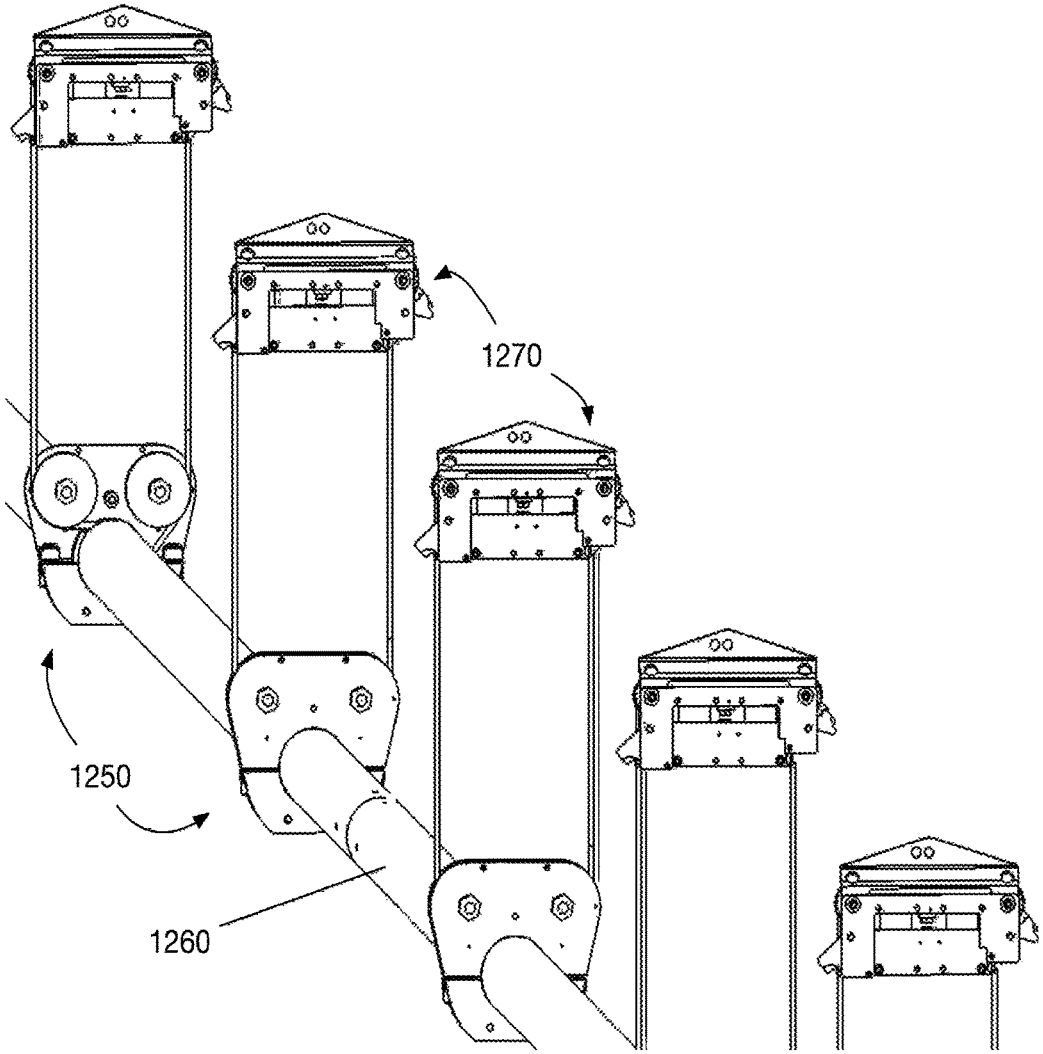

For greater context, FIG. 12D illustrates a series of exit mechanisms 1250 in conjunction with an enclosure 1260. FIG. 12D also illustrates cooperation with a series of trim adjustment mechanisms 1270, discussed in greater detail herein.

One potential advantage of the ability to configure a position and path of the elongate members is to accommodate a variety of cable management systems. Hoist and lift systems often require cabling for various purposes, including carrying power, such as to a motor and/or lighting, control signals, etc. These systems accommodate one or more lengths of cable during the travel of a hoist system throughout its range of motion. In an embodiment where a source of power, for example, is in an elevated position, and a lifting enclosure of the system travels downward, cabling must be accommodated at an uppermost position of the lifting enclosure, where a distance between the enclosure and the power source is least, a lowermost position of the lifting enclosure, where a distance between the enclosure and the power source is greatest, and at each point in between along a path of travel of the lifting portion of the hoist system. If the cabling is not properly accommodated, problems such as kinking, undue wear on the cables, etc., may occur under certain conditions. An elongate member exit arrangement of the style illustrated by FIG. 12C may, for example, provide adequate spacing between elongate members in an elongate member pair to permit a cable management mechanism to reside between these paired elongate members.

Figure 13A:
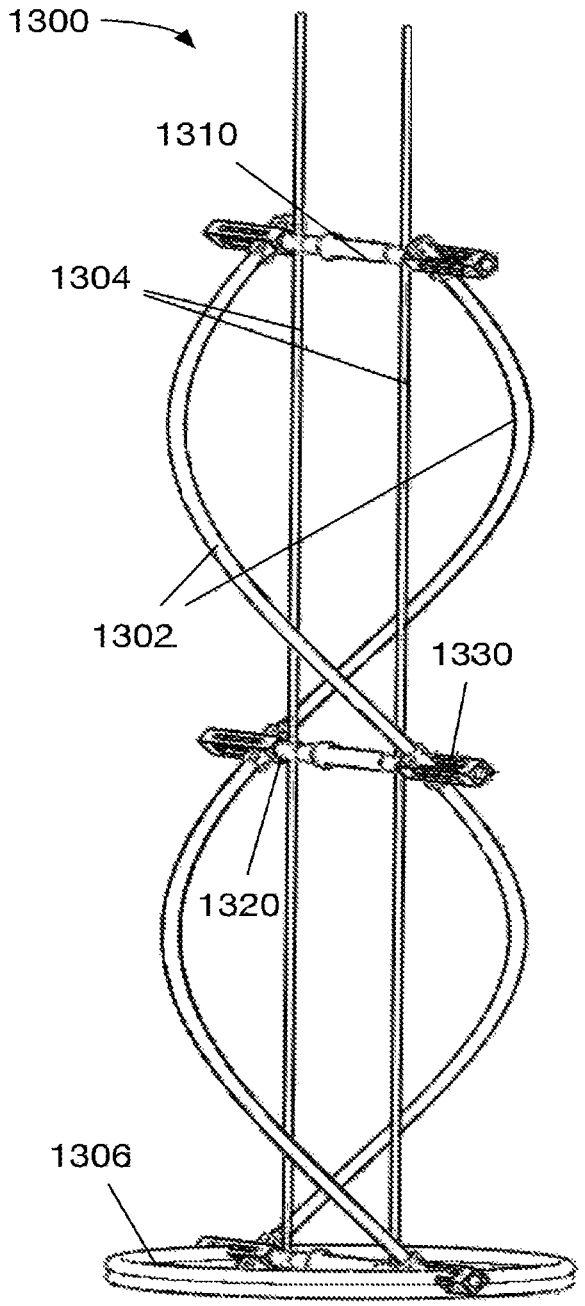
FIGS. 13A and 13B illustrate perspective views of alternative embodiments of a cable management system in accordance with the invention.

FIG. 13A illustrates an embodiment 1300 of a cable management system that, depending on a particular implementation, may lead to a more compact system for managing cables 1302 in an embodiment having paired elongate members 1304 in relatively close proximity. In other embodiments, the same concept may be adapted for use with a single or a greater number of elongate members 1304. In this embodiment, the cable management system 1300 comprises guide bars 1310 slideably disposed on the elongate members 1304 by way of holes in a cylindrical rod 1320 of the guide bars 1310 (see also FIG. 13C). Depending upon a particular implementation, it may be desirable that multiple guide bars 1310 be chained or otherwise connected together (not illustrated) to limit a maximum separation between adjacent guide bars 1310 during operation. In one embodiment, the separation is limited to 18 inches between adjacent guide bars 1310.

At either end of the cylindrical rod 1320 are rectangular guides 1330 which may be able to rotate with respect to the cylindrical rod 1320, either freely, or through a predetermined, limited angle of rotation. The guides 1330 accommodate the cables 1302 to be managed. The cables 1302 may be fixed within the guides 1330, or may slide freely or with some resistance through the guides 1330. At an end of the resulting coil/helix of cables (i.e., in an operative position, generally at a top or bottom of the coil), a cylindrical rod 1320 is attached to a base portion 1306, which may be comprised of a discrete base, or may merely constitute cables 1302 that have coiled upon a lessening of the length of elongate member 1304 that is extended (rather than, for example, coiled upon a drum during use). That is, guide bars need not be attached to a base. Alternatively, in an application where a base is desired, the base could consist of a platform, of plastic or other suitable material, attached to the pipe or wire rope diverter assembly, and which provides a support for coils of managed cable 1302 to lay upon.

Figure 13B:
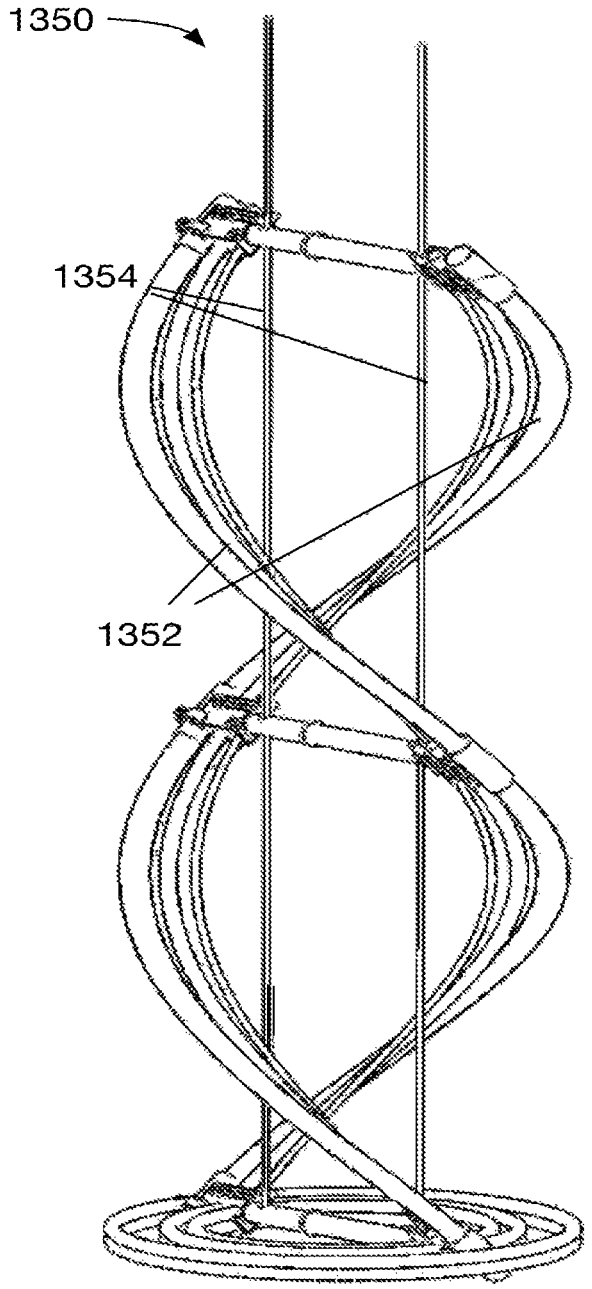
Figure 13C:
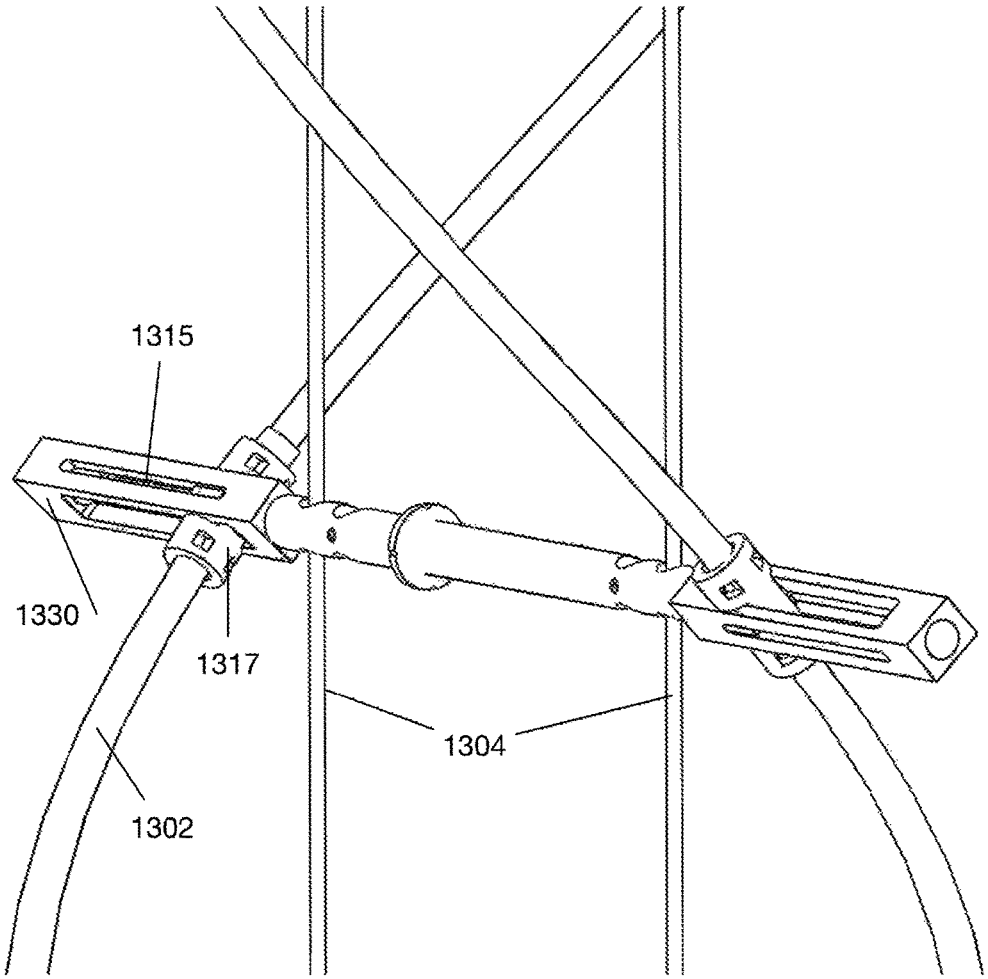
FIG. 13C illustrates an enlarged perspective view of the FIG. 13A embodiment of a cable management system in accordance with the invention.

As illustrated by FIG. 13B, showing an alternative embodiment 1350 accommodating three cables 1352 along two elongate members 1354, the accommodated cabling may be fixedly attached to a guide 1330 by any of a variety of methods. In operation, as a distance between a source of the information carried by the cables (e.g., power) and a traveling hoist assembly increases, a distance between respective cylindrical rods increases, and a coil or helix of cable expands in length along a path of the elongate members 1354 while decreasing in width. Referring to FIG. 13A, a cable management system 1300 is illustrated in a substantially expanded or extended position. As the base 1306 moves upward or retracts toward a power source (not shown), the length of the system 1300 collapses, while expanding in circumference. As shown in greater detail in FIG. 13C, in an embodiment as illustrated by FIG. 13A and others, the guides 1330 may be adapted with a slot 1315 through which a slider 1317 coupled to a cable 1302 has freedom of movement, permitting movement of the cable 1302 in a direction substantially inline with the guide bar 1310, i.e., radially outward from a center axis of the approximate cylinder formed by the helical coils of cable 1302, thereby further accommodating the expanding circumference referenced herein. As further disclosed herein, the cable 1302 may further be fixed or slide freely within a slider 1317.

In alternative embodiments, there could be four (4) or more cables as necessary. In another embodiment, spacer guides could form a plus (+) or cross pattern, enabling four (4) or additional cable attachment points. One skilled in the art will appreciate that these concepts may be applied as well to an embodiment like that illustrated by FIG. 13B, among countless other applications.

Figure 14A:
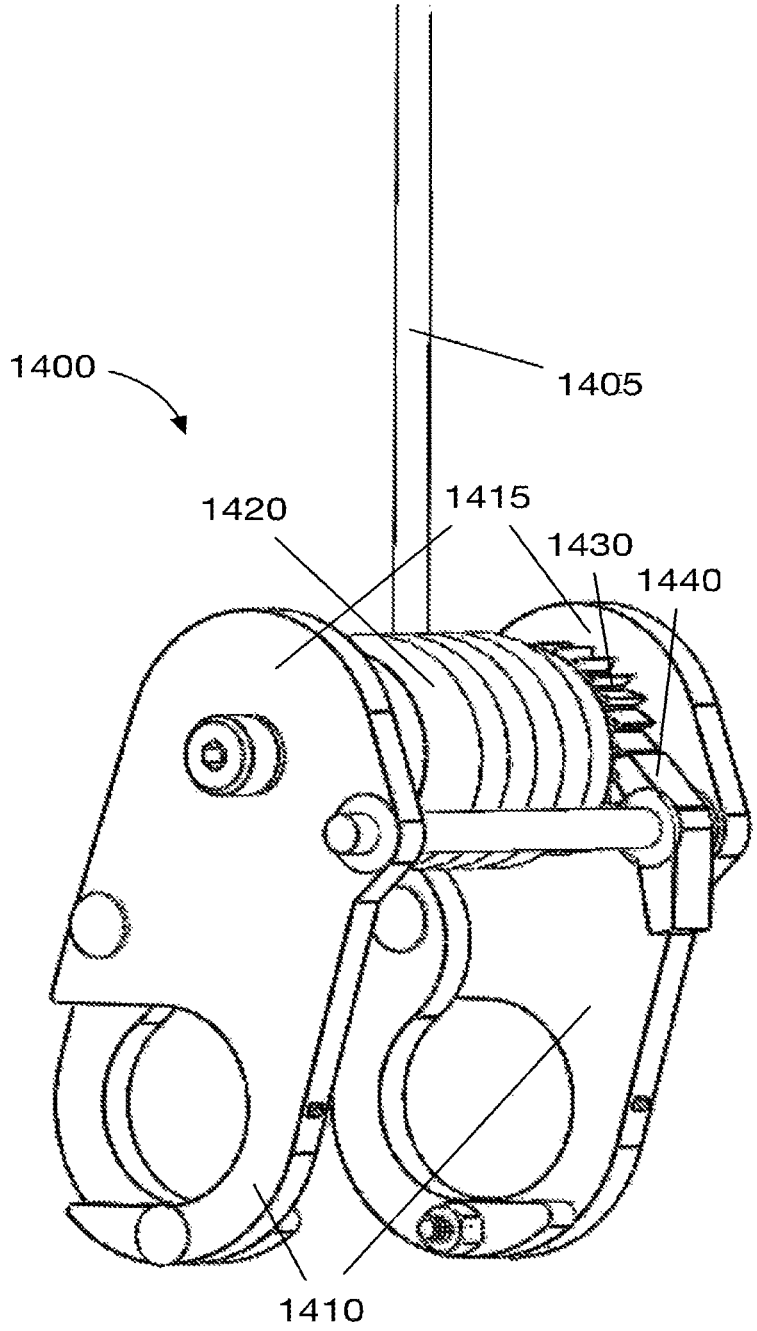
FIGS. 14A and 14B illustrate perspective views of alternative embodiments of an elongate member trim mechanism in accordance with the invention.

In another aspect of the invention, various mechanisms are provided for making adjustments to a length of an elongate member upon installation of a hoist system, or at another time during use thereof. Such trim adjustment mechanisms may be useful to make relatively fine adjustments to a working length of elongate member, as to level a hanging hoist, conform a length of one elongate member to that of other elongate members, etc. In one embodiment, a cable adjustment mechanism 1400 takes a form such as is illustrated by FIG. 14A. The adjustment mechanism 1400 in this embodiment comprises: clamps 1410 for attaching the mechanism 1400 to a hoist enclosure, such as a pipe or batten (not shown), a drum 1420 supported by brackets 1415 for winding a length of elongate member 1405 thereupon, a cog or cogs 1430 connected to the drum 1420, and one or more keys or latches 1440 for biasing against the cog 1430 to lock a movement of the drum shaft 1420 in one of a number of discrete positions, which correlates to one of a number of extended lengths of elongate member 1405. By rotating the drum 1420 using a crank or other appropriate tool, a length of extended elongate member 1405 may be adjusted, and locked into place with the latch 1440. In this embodiment, the adjustment mechanism 1400 may travel with a batten or other hoist enclosure, enabling fine adjustment of a working length of elongate members 1405, which may extend downward from a hoist fixed at an overhead location.

Figure 14B:
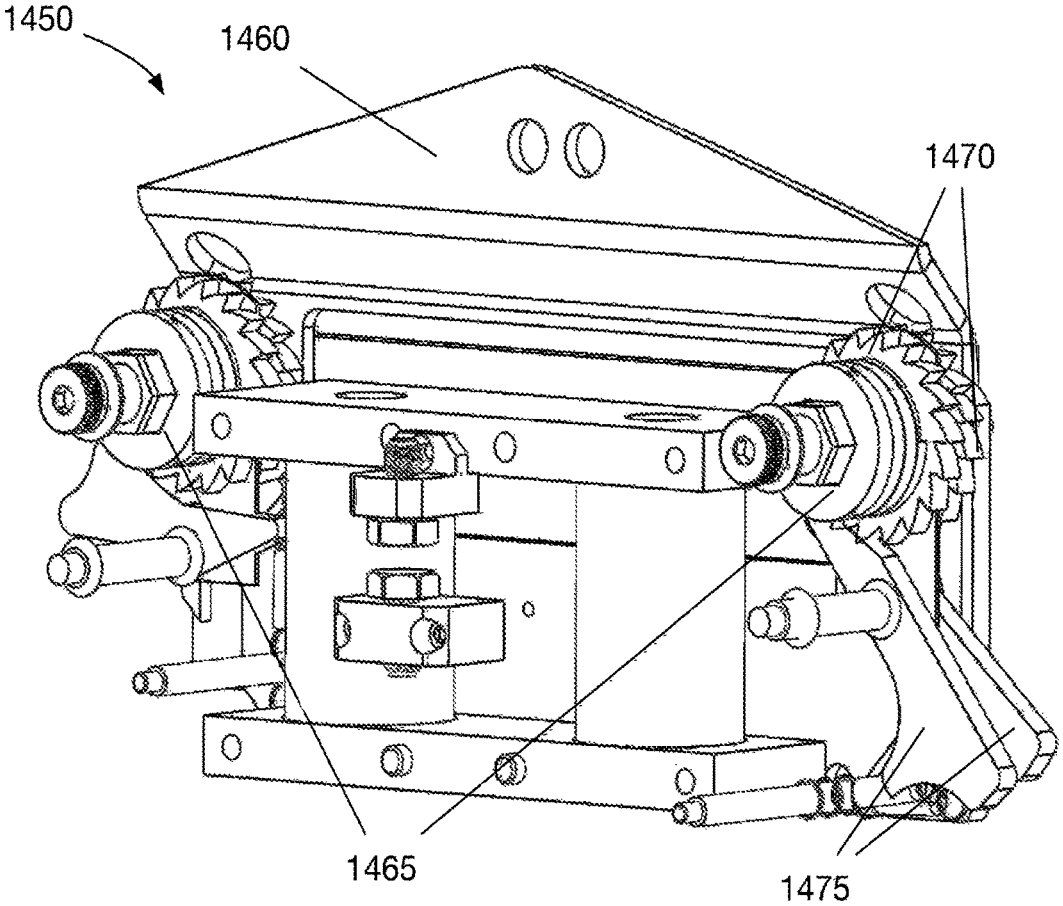

FIG. 14B illustrates an alternative embodiment of a trim mechanism 1450, which may be useful in a variety of applications, including for use with a self-climbing hoist, where it may be preferred that trim adjustment be made at an overhead support location, rather than at a point of the enclosure, which travels while the hoist is in moving operation. In this embodiment, an exemplary trim mechanism 1450 includes an attachment plate 1460, for attaching to a fixed overhead support location. Alternatively, the trim mechanism 1450 may be inverted for attachment to a traveling hoist enclosure. The mechanism 1450 further includes a pair of drum 1465/cog 1470 pairs and latches/keys 1475, operatively similar to the embodiment illustrated by FIG. 14A. As shown in FIG. 14B, the trim mechanism 1450 may be adapted with double, offset cogs 1470 and dual keys 1475, to provide for finer trim adjustment, as may be desirable in certain applications.

Within the broader concept of a compact hoist system in accordance with the invention, many specific implementations are contemplated, along with various alternatives. With respect to exterior dimensions, in one embodiment, an enclosure (e.g., batten, etc.) having a diameter of 2.125 (2 and ⅛) inches and 20 feet in length is utilized with two-foot drums. Some scalability might be achieved by varying the length and/or size of various components, while more extreme scalability might be achieved by coupling multiple such apparatus end to end, or using only half (e.g., a single motor-drum combination), which itself might be scaled as necessary, depending upon a particular application or environment.

Figure 15A:
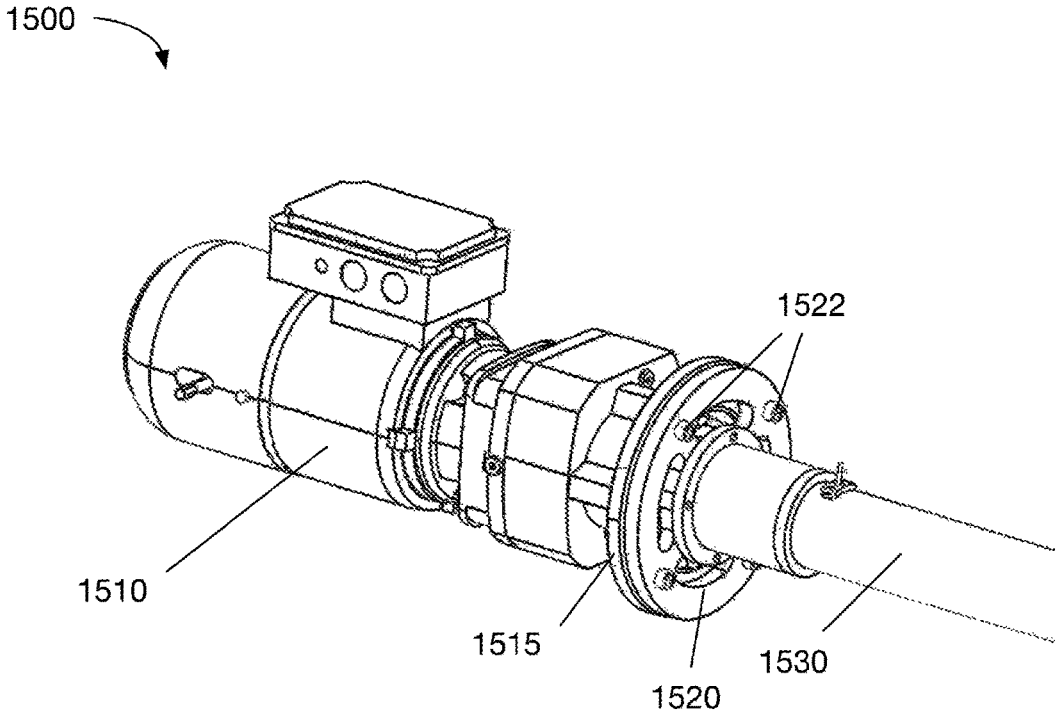
FIGS. 15A-C illustrate perspective views of alternative embodiments of a motor replacement system in accordance with the invention.
Figure 15B:
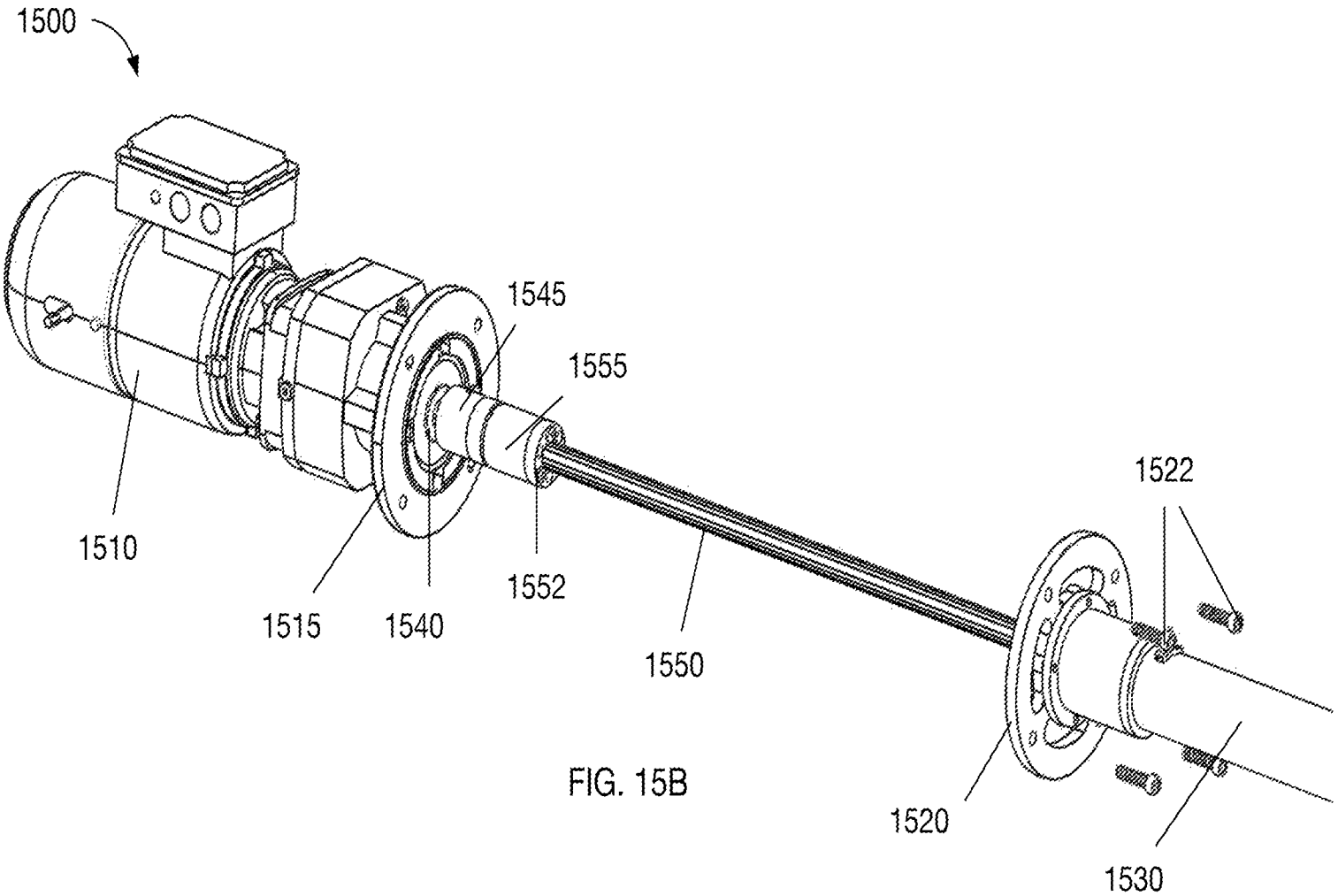
Figure 15C:
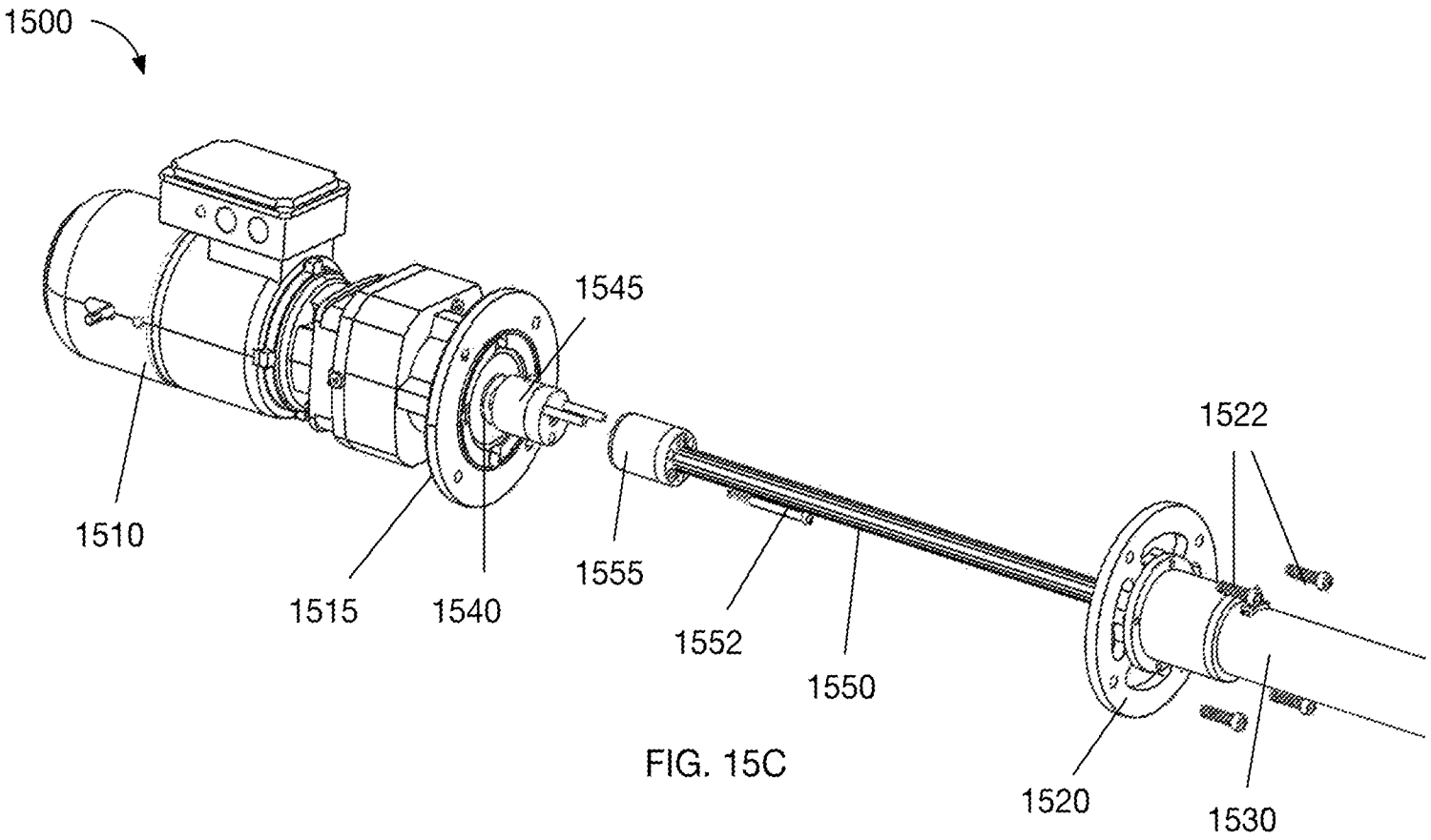

Various motors might be used in accordance with the invention, depending upon a particular application, among them a variety of currently available tubular motors, or any of a variety of servo motors, such as stepper motors or other suitable drive unit, among others, in environments where it may be desirable to receive feedback regarding a motor's position. It may be desirable in certain environments to, in contrast to a number of known systems, have the ability to relatively quickly and easily change a motor or other drive power source. In one embodiment, an example of which is illustrated by FIGS. 15A-C, a drive system 1500 is provided that enables the removal and replacement of an associated motor 1510, for repair, replacement with a motor having greater or lesser capabilities, etc. FIG. 15A shows a motor 1510 coupled inline to a batten, here a pipe 1530, by a motor flange 1515 and a pipe flange 1520 by way of bolts/screws or other suitable attachment mechanism 1522. FIGS. 15B and 15C illustrate the same mechanism 1500 at different stages of motor 1510 removal or attachment.

In FIG. 15B, bolts 1522 have been removed and the motor 1510 pulled away from the pipe 1530, exposing a drive shaft 1540 coupled to a spline shaft 1550 by a drive coupling 1545 and a spline coupling 1555, held together by drive bolts/screws 1552. Upon removal of the drive bolts 1552, the drive shaft 1540 and the spline shaft 1550 may be separated, as shown by FIG. 15C, leaving the motor 1510 free of the hoist mechanism for replacement.

An elongate member, e.g., rope, cable, etc., might be attached to a drum in a variety of ways. Multiple cables might be associated with a single drum or multiple drums. In one embodiment, a connector or sleeve facilitates installation of the member at one end to a drum. The end is pushed into the connector, which might sit in a cutout in the drum, and forced through spiral grooves or other features adapted to clamp or grasp the end, with a second end emerging through an opening in the batten. Outside of the batten, the elongate member might pass through a sheave assembly or other suitable means for supporting the batten. In one embodiment, the elongate member is attached at its other end with a thimble to a triangular or other shape block, as desired, which is attached to a beam clamp. In one embodiment, the beam clamp is formed from two partially overlapping J-shaped members, as illustrated herein.

While the description herein may refer to specific reference numbers in the figures, the description is likewise applicable to analogous elements having different numbers. For example, descriptions of features of a drum 220 may likewise apply to others such as drums 320*a* and 320*b*, etc., and components such as a drum 220 may be used with any other features, although they might only be disclosed herein with respect to another embodiment.

As noted above, battens are only one embodiment of an enclosure in accordance with the invention. The concepts of the invention may have applicability to other structures/enclosures, etc. as well, and numerous additional applications are further contemplated. For example, the inventions have been described primarily with respect to an enclosure that takes the form of a tubular structure, e.g., a circular, elliptical or otherwise rounded structure. As will be clear to one skilled in the art from the disclosure, however, other shapes, including square, rectangular and other polygonal and other shapes as well, depending upon a desired application. Nor is the invention limited to any particular material or structural framework. The concepts, methods and apparatus disclosed may be used in countless other applications not expressly mentioned herein without departing from the scope and spirit of the invention.

The inventions have been described for connection to an overhead support for lifting objects vertically, primarily in performance-type environments. Other implementations are contemplated, however, such as for pulling up an incline, and dragging/towing an object across a horizontal surface, among others, as well as in a variety of other venues and outdoors. An embodiment is also contemplated in which a vertical orientation of a hoist in accordance with the invention is substantially reversed, such that batten is mounted in an elevated position with elongate members extending outwardly therefrom, for attachment to an object to be lifted or moved.

As described herein, positional references and terms of orientation, such as overhead, elevated, above, below, horizontal, vertical, etc., herein assume a certain orientation of the described apparatus, are not intended to dictate precise angles or positions, and may be reversed or otherwise varied, depending upon the relative locations and orientations of the items involved. Furthermore, references to a clock dial have been used herein, i.e., positions such as 3:00, 9:00, 12:00, etc., where, when viewing a cross section of an enclosure in its operative orientation, vertically below an overhead support (in an embodiment where an overhead support is applicable), 12:00 indicates a direction directly vertical upward to the overhead support, 3:00 and 9:00 indicate directions to the right and left, respectively, at 90 degree angles to a vertical direction, in a plane perpendicular to a length of the enclosure. One skilled in the art will recognize that these references are approximate and that, given the effectively limited number of potential options in a 360 degree circle, all possible orientations are expressly contemplated depending upon a particular application, absent highly unexpected results owing to a highly specific orientation.

A means for causing translation of a drum due to rotational motion is described herein by way of example as a rod having acme threading, but variations are contemplated. A variety of threading techniques are known, and the threads need not be trapezoidal in cross section and/or formed at any particular angle or pitch. Nor must a threaded rod be used at all where other drive means are available.

The inventions have been described in the context of a system whose primary mechanics (motors, drums, drive features, etc.) may be enclosed within a batten or other support enclosure. The system, however, might further include external features as described, including elongate members, mechanism for attachment to an elevated support, pulleys, sheave assembly, etc. In addition, various primary features might be disposed externally, depending upon a nature of the enclosure used and the application environment. Many features as well have been described as sharing a center axis, but a departure from this is likewise contemplated, as described herein. Furthermore, while the invention has often been described generally in the context of a smaller, more compact system, the concepts herein are applicable and scalable to much larger-scale operations as well.

In describing the inventions, various articles may be described as coupling or being coupled, connecting or being connected, attached, etc., to one another. This phraseology is not intended to exclude potential intermediate parts, i.e., coupling and connecting may be direct or indirect, unless otherwise limited.

What is claimed is:

1. A cable management system for a hoist system, the hoist system configured to be supported by a fixed structural member via an elongate member, the hoist system configured to move between an extended position and a retracted position relative to the fixed structural member, the cable management system comprising:

a guide bar having an opening configured to slidably receive the elongate member;

a cable configured to be electrically coupled to the hoist system to provide electrical power to the hoist system; and a first guide connected to a first end of the guide bar and rotatable with respect to the guide bar, the first guide being connected to the cable to inhibit movement of the cable relative to the first guide, the first guide directing the cable at least one half of a revolution around the elongate member.

2. The cable management system of claim 1, further comprising:

a base for supporting a coiled collection of the cable, wherein a height of the coiled collection increases as the hoist system moves from the extended position to the retracted position, and wherein the first guide is adapted to guide a position of the cable to form a substantially cylindrical shape as the hoist system moves from the extended position to the retracted position.

3. The cable management system of claim 1, wherein the hoist system is configured to move from the extended position to the retracted position when the elongate member is wound onto a drum of the hoist system.

4. The cable management system of claim 1, wherein the cable is a first cable, the cable management system further comprising:

a second cable configured to be electrically coupled to the hoist system to provide electrical power to the hoist system; and a second guide connected to a second end of the guide bar opposite the first end of the guide bar and rotatable with respect to the guide bar, the second guide being connected to the second cable, the first and second guides positioning the first and second cables in a substantially double-helical arrangement.

5. The cable management system of claim 1, wherein the cable management system is configured to be coupled to a pair of elongate members, and wherein the hoist system is configured to be supported by the fixed structural member via the pair of elongate members, the cable management system further comprising:

a plurality of the guide bars spaced along the pair of elongate members, the guide bars being chained together to limit a maximum separation between adjacent guide bars during operation.

6. The cable management system of claim 5, wherein the maximum separation between adjacent guide bars is limited to eighteen inches.

7. A cable manager for use with a cable, comprising:

a guide bar having an opening formed therein;

a first guide connected to a first end of the guide bar and rotatable with respect to the guide bar;

a second guide connected to a second end of the guide bar opposite the first end of the guide bar and rotatable with respect to the guide bar; and sliders movable within an opening formed in each guide from a first position closer to a center point of the guide bar to which the first guide is connected to a second position more distant from the center point.

8. The cable manager of claim 7, wherein the slider has formed therein an opening for supporting the cable.

9. The cable management system of claim 4, wherein the first and second guides position the first and second cables in the substantially double-helical arrangement when the hoist system is in the extended position.

10. The cable management system of claim 9, wherein the first and second guides position the first and second cables in a coiled collection when the hoist system is in the retracted position.

11. The cable management system of claim 1, wherein the cable management system is configured to be coupled to a pair of elongate members, and wherein the hoist system is configured to be supported by the fixed structural member via the pair of elongate members, the cable management system further comprising:

a plurality of the guide bars spaced along the pair of elongate members, the plurality of guide bars configured to guide the first and second cables relative to the elongate member as the hoist system moves between the extended position and the retracted position.

12. A cable management system for a hoist system, the hoist system configured to be supported by a fixed structural member via an elongate member, the hoist system configured to move between an extended position and a retracted position relative to the fixed structural member, the cable management system comprising:

a guide bar having an opening configured to slidably receive the elongate member;

first and second cables configured to be electrically coupled to the hoist system to provide electrical power to the hoist system;

a first guide coupled to the guide bar and rotatable with respect to the guide bar, the first guide being connected to the first cable to inhibit movement of the first cable relative to the first guide; and a second guide coupled to the guide bar and rotatable with respect to the guide bar, the second guide being connected to the second cable to inhibit movement of the second cable relative to the second guide, the first and second guides positioning the first and second cables in a substantially double-helical arrangement;

wherein the cable management system is configured to be coupled to a pair of elongate members, and wherein the hoist system is configured to be supported by the fixed structural member via the pair of elongate members, the cable management system further comprising:

a plurality of the guide bars spaced along the pair of elongate members, the plurality of guide bars configured to guide the first and second cables relative to the pair of elongate members as the hoist system moves between the extended position and the retracted position.

13. The cable management system of claim 12, wherein the first and second guides position the first and second cables in the substantially double-helical arrangement when the hoist system is in the extended position.

14. The cable management system of claim 13, wherein the first and second guides position the first and second cables in a coiled collection when the hoist system is in the retracted position.

15. The cable management system of claim 1, wherein the guide bar is a first guide bar having a second end opposite the first end, and wherein the opening of the guide bar is a first opening, the cable management system further comprising:

a second guide bar having a first end, a second end opposite the first end, and a second opening configured to slidably receive the elongate member, the first ends of the first and second guide bars configured to be positioned on one side of the elongate member, the second ends of the first and second guide bars configured to be positioned on another side of the elongate member; and a second guide connected to the second end of the second guide bar and rotatable with respect to the second guide bar, the second guide being connected to the cable to inhibit movement of the cable relative to the second guide;

wherein the cable extends from the first guide on the first side of the first guide bar to the second guide on the second side of the second guide bar.

16. The cable management system of claim 1, wherein the guide bar is configured to be coupled to the elongate member such that the guide bar is inhibited from rotating about the elongate member.

* * * * *